United States Patent [19]

Blaese et al.

[11] 4,413,390

[45] Nov. 8, 1983

[54] CASKET-PLACER AND CASKET-LOWERING APPARATUS

[75] Inventors: Herbert R. Blaese; Christopher R. Lorenc, both of Chicago, Ill.

[73] Assignee: Wilbert, Inc., Forest Park, Ill.

[21] Appl. No.: 374,100

[22] Filed: May 3, 1982

[51] Int. Cl.[3] ..... A61G 19/00

[52] U.S. Cl. ..... 27/32

[58] Field of Search ..... 27/32, 28; 188/155, 188/156, 157, 161, 162, 171, 174, 158

[56] References Cited

U.S. PATENT DOCUMENTS

| | | | |
|---|---|---|---|
| 1,450,092 | 3/1923 | Leavitt | 27/32 |
| 1,780,700 | 11/1930 | Cordonnier et al. | 27/32 |
| 1,828,391 | 10/1931 | Canaday | 27/32 |
| 2,012,367 | 8/1935 | Wilkirson | 27/32 |
| 2,028,442 | 1/1936 | Dormer | 27/32 |
| 2,091,909 | 8/1937 | Canaday | 27/32 |
| 2,117,518 | 5/1938 | Smola | 27/32 |
| 2,124,038 | 7/1938 | Lohberg | 27/26 |
| 2,163,171 | 6/1939 | Haase | 27/32 |
| 2,163,172 | 6/1939 | Haase | 27/32 |
| 2,163,173 | 6/1939 | Haase | 27/32 |
| 2,163,174 | 6/1939 | Haase | 27/32 |
| 2,250,985 | 7/1941 | Benson | 254/172 |
| 2,285,923 | 6/1942 | Haase | 188/82 |
| 2,457,671 | 12/1948 | Haase | 27/32 |
| 2,529,948 | 11/1950 | Jones | 61/67 |
| 2,588,445 | 3/1952 | Wilkirson | 27/32 |
| 2,619,321 | 11/1952 | Haase | 254/136 |
| 2,692,056 | 10/1954 | Woods | 212/135 |
| 2,762,106 | 9/1956 | Wilkirson | 27/32 |
| 2,781,571 | 2/1957 | Blachly | 27/32 |
| 2,784,329 | 3/1957 | Bessiere | 310/93 |
| 2,870,519 | 1/1959 | Yeazel | 27/32 |
| 2,901,137 | 8/1959 | Emert | 214/394 |
| 2,918,718 | 12/1959 | Oberwegner | 27/28 |
| 3,015,472 | 1/1962 | Scott | 254/168 |
| 3,086,621 | 4/1963 | Dale | 27/32 X |
| 3,095,066 | 6/1963 | Abplanalp, Jr. | 27/32 X |
| 3,273,860 | 9/1966 | Weisenbach | 254/184 |
| 3,364,536 | 1/1968 | Williams | 27/1 |
| 3,838,846 | 10/1974 | Ostrom | 254/172 |

*Primary Examiner*—John D. Yasko

*Attorney, Agent, or Firm*—Willian, Brinks, Olds, Hofer, Gilson & Lione, Ltd.

[57] ABSTRACT

A generally rectangular-shaped casket-placer and casket-lowering apparatus for supporting a casket over a grave opening during a graveside service and for lowering the casket into the grave opening, or into the base of a burial vault in the grave opening, for interment after the conclusion of the graveside service includes side rails and end rails. The front or upper end rail is operatively connected to one of the side rails and transmits rotary motion of the one side rail through a shaft and gear mechanism in a combination braking and power transmission head to the armature of a D.C. motor generator which is located at one of the four corners of the apparatus and controls the speed of lowering of the casket by the apparatus. The lowering speed of the casket is controlled by an electrical loading circuit which incorporates a D.C. motor generator having an armature which is operatively connected to rotate with the side rails and the front end rail. The electrical loading circuit includes a zener diode having a predetermined threshold voltage which prevents current flow through the loading circuit and allows rotation of the armature of the D.C. motor generator, and rotation of the side rails driven by downward movement of the casket until a predetermined threshold voltage has been reached, thereby controlling and braking the lowering speed of the casket. In addition, an improved casket-placer and supporting arm is disclosed which incorporates a roller and slot locking arrangement.

37 Claims, 34 Drawing Figures

47
46
90
44
168
50
55
15
90
42
40
59
55
126
14
54
54
56
15
54
83
140
56
54
56
14
126
112
57
55
56
57
43
53
110
55
45
48
143
128
52

46
168
46
44
170
167

41
42
43
44
45
46
47
48
49
50
51
52
53
54
55
56
57
18
25
40
83
112
122
126
128

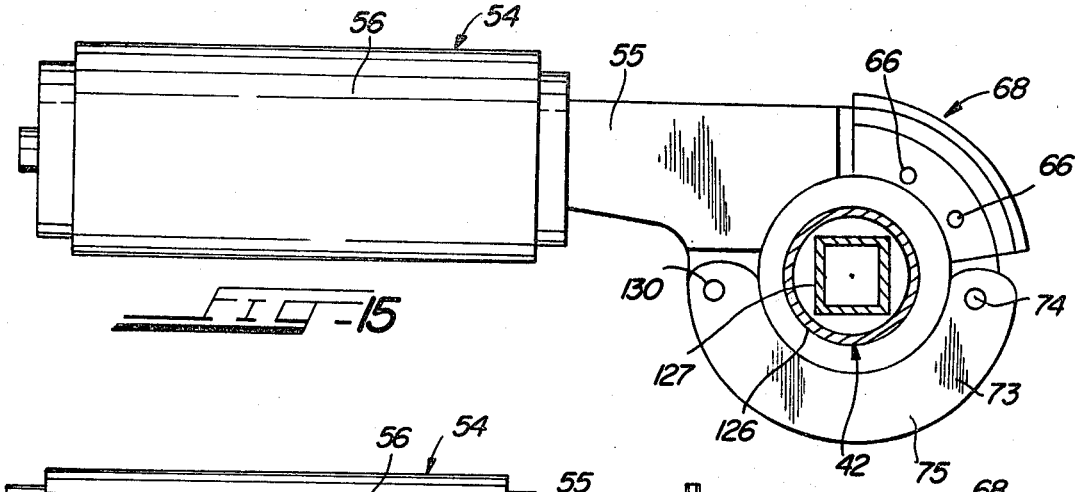
FIG-15
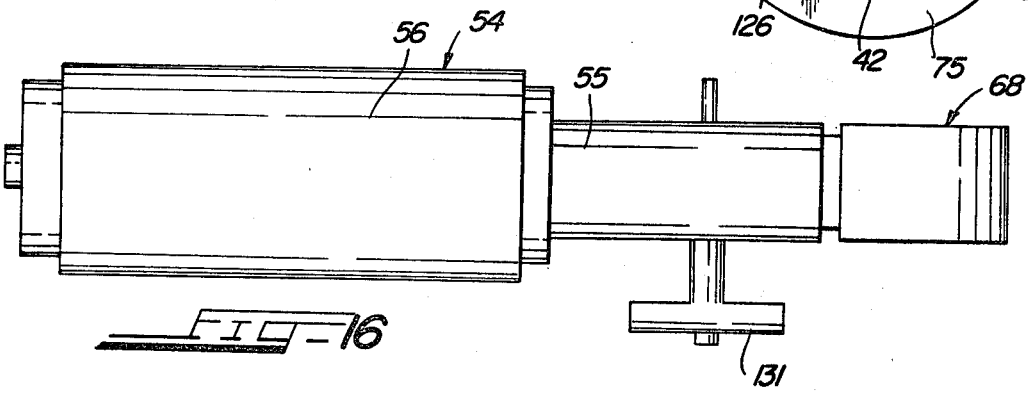
FIG-16
FIG-17
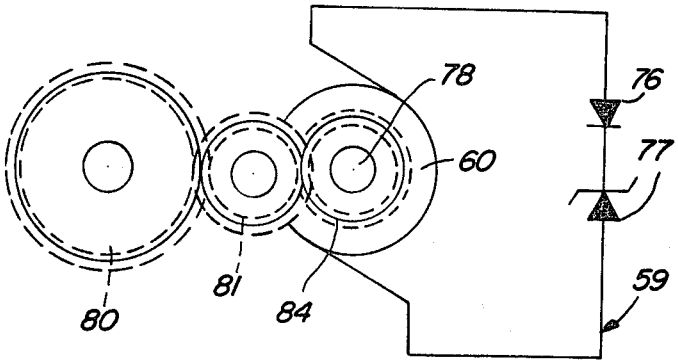

FIG-27
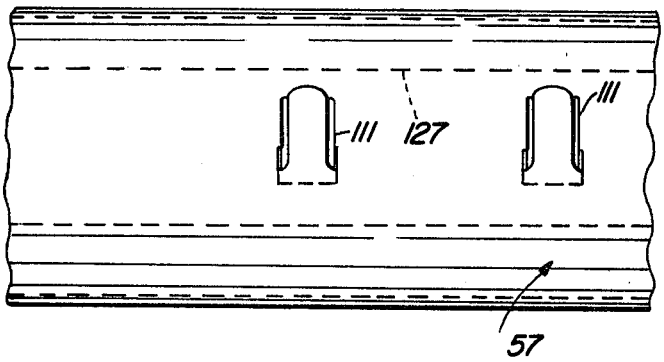
FIG-31
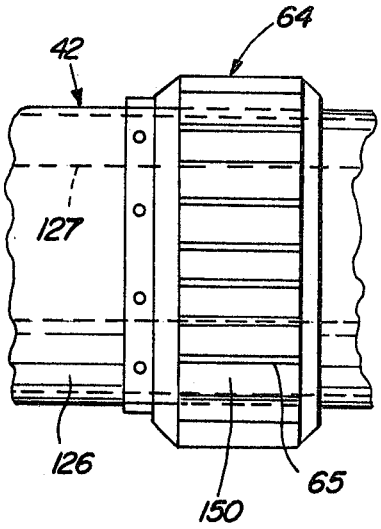
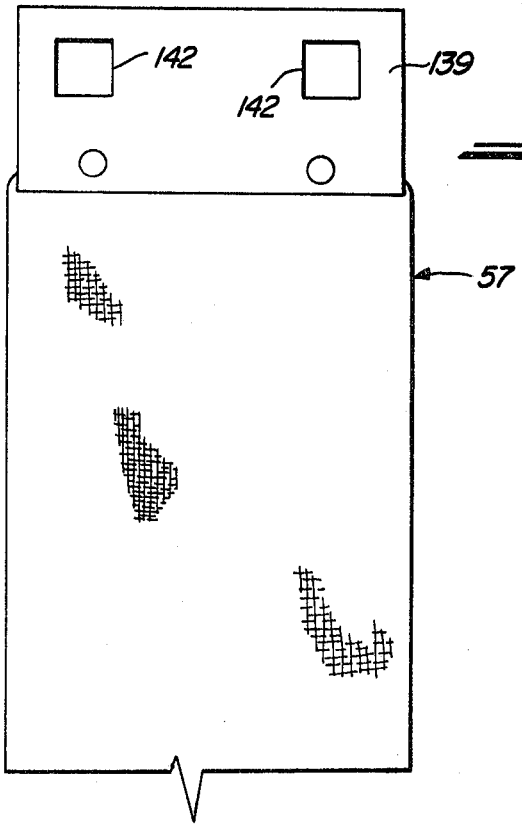
FIG-28

CASKET-PLACER AND CASKET-LOWERING APPARATUS

BACKGROUND OF THE INVENTION

Apparatus for placing a casket over a grave opening in a cemetery during a graveside service and for lowering the casket into the grave opening, or into the base portion of a burial vault in the grave opening, for interment at the conclusion of the graveside service have been known and used heretofore and among these are the casket-lowering apparatus which are disclosed in U.S. Pat. No. 2,012,367 granted Aug. 27, 1935 to Jim P. Wilkirson on "Casket Lowering Apparatus"; U.S. Pat. No. 2,588,445 granted Mar. 11, 1952 to Jim P. Wilkirson on "Casket Placer"; U.S. Pat. No. 2,762,186 granted Sept. 11, 1956 to Jim P. Wilkirson on "Casket Placer"; and the following additional prior art patents:

| Pat. No. | Patentee | Title | Date |
|---|---|---|---|
| 1,450,092 | Leavitt | Burial Apparatus | Mar. 27, 1923 |
| 1,780,700 | Cordonnier et al | Coffin Lowering Device | Nov. 4, 1930 |
| 1,828,391 | Canaday | Casket Lowering Apparatus | Oct. 20, 1931 |
| 2,028,442 | Dormer | Load Handling Device | Jan. 21, 1936 |
| 2,091,909 | Canaday | Attachment for Casket Lowering Devices | Aug. 31, 1937 |
| 2,124,038 | Lohberg | Casket Support | July 19, 1938 |
| 2,163,171 | Haase | Sectional Burial Apparatus | June 20, 1939 |
| 2,163,172 | Haase | Power Operable Burial Device | June 20, 1939 |
| 2,163,173 | Haase | Universal Burial Device | June 20, 1939 |
| 2,163,174 | Haase | Power Attachment for Burial Devices | June 20, 1939 |
| 2,285,923 | Haase | Winch Drag Mechanism | June 9, 1942 |
| 2,457,671 | Haase | Burial Apparatus | Dec. 28, 1948 |
| 2,619,321 | Haase | Burial Unit Handling Device | Nov. 25, 1952 |
| 2,870,519 | Yeazel | Casket Carriage | Jan. 27, 1959 |
| 3,364,536 | Williams | Burial Vault Cover Handling Apparatus | Jan. 23, 1968 |

However, one of the problems experienced in the use of certain of the prior art casket-placer and casket-lowering apparatus has been that the speed of the casket-lowering action of certain of such prior apparatus has commonly been controlled by flywheel speed governors and associated mechanical friction braking devices which are subject to loss of the desired friction characteristics by reason of wear, contamination of the friction members due to grease, or other contaminants, as well as mechanical weaknesses in the system, and for other reasons, with the result that the control of the speed of the casket-lowering operation by such prior art apparatus has been erratic and not capable of precise or accurate control and the operation of such prior art apparatus has been unsatisfactory.

OBJECTS OF THE INVENTION

An object of the present invention is to provide a new and improved casket-placer and casket-lowering apparatus for placing a casket in position above a grave opening during a graveside service and then lowering the casket into the grave opening, or into the base portion of a burial vault in the grave opening, for interment after the conclusion of the graveside service.

Another object of the invention is to provide a new and improved casket-placer and casket-lowering apparatus in which the casket is lowered into the grave opening by the weight of the casket on the side rail members of the apparatus and which are responsive to the weight of the casket bearing on the casket-placer and casket-supporting arm members and on flexible casket-supporting and casket-lowering strap members which are operatively connected to the side rail members of the apparatus and in which the speed of lowering the casket into the grave opening is controlled by a novel electromechanical control and braking means which is not subject to wear from friction in use, or to temperature variations, or to contamination by foreign materials, or similar causes, as have been the mechanical friction control and braking devices incorporated in certain of the prior art casket-placer and casket-lowering apparatus.

An additional object of the invention is to provide in the new casket-placer and casket-lowering apparatus a novel braking and power transmission head unit which is arranged at one of the four corners of a generally rectangular-shaped supporting frame of the casket-placer and casket-lowering apparatus and which includes a novel electromechanical control and braking means for controlling and braking the speed of the casket-lowering operation on the casket-placer and casket-supporting arm members and on the flexible casket-supporting and casket-lowering strap members which are embodied in the invention.

A further object of the invention is to provide in the new casket-placer and casket-lowering apparatus a novel driving means in the form of the side rail members and the casket-placer and casket-supporting arm members and the flexible casket-supporting and casket-lowering strap members operatively connected thereto, and a novel manually controlled latching device for mechanically latching the driving means for the side rail members and the casket-placer and casket-supporting arm members and the flexible casket-supporting and casket-lowering strap members against operation until such time as the graveside service has been completed and it is desired to lower the casket into the grave opening, or into the base of a burial vault in the grave opening, for interment, at which time the side rail members and the casket-placer and casket-supporting arm members and the casket-supporting and casket-lowering flexible strap members may be manually unlatched by the funeral director to lower the casket into the grave opening for interment.

An additional object of the invention is to provide in the new casket-placer and casket-lowering apparatus a novel manually operated gear mechanism, which is operatively connected to the the side rail members, and a manually operated crank member for rewinding the flexible casket-supporting and casket-lowering strap members onto the side rail members of the apparatus after the casket has been interred in the grave opening.

Another object of the invention is to provide therein a novel manually operable means for rewinding the flexible casket-supporting and casket-lowering strap members onto the side rail members to raise the casket, if necessary for any reason, during the interment operation.

A further object of the invention is to provide in the new casket-placer and casket-lowering apparatus a novel construction and arrangement of casket-placer and casket-supporting arm members which are mounted on and are latchingly engaged with the side rail members of the apparatus and are initially disposed and latched in a generally horizontal position thereon to support the casket during the graveside service but are rotated downwardly on the side rail members into a generally vertical position under the weight of the casket bearing thereon after the conclusion of the graveside service but are automatically unlatched from the side rail members of the apparatus as the casket-placer and casket-supporting arm members are pivoted downwardly into a generally vertical position in which they are automatically unlatched from the side rail members and may be removed from the side rail members for reuse after the conclusion of the interment.

A further object of the invention is to provide therein a novel electromechanical control and braking unit or means for precisely controlling and braking the lowering speed of the casket on the casket-placer and casket-supporting arm members and on the flexible casket-supporting and casket-lowering strap members and which includes an electrical loading circuit in which is incorporated at D.C. motor generator, the armature of which is operatively interconnected with the driving means for the side rail members, and in which the loading circuit is not subject to variations in temperature, load and internal friction of the apparatus.

An additional object of the invention is to provide therein an electromechanical control and braking circuit for precisely controlling the lowering speed of the side rail members and of the casket-placer and casket-supporting arm members and the flexible casket-supporting and casket-lowering strap members and which includes an electrical loading circuit which incorporates a D.C. motor generator having a rotatable armature which is operatively connected to the driving means for the side rail members and generates an electrical current for the loading circuit which is responsive to the speed of rotation of the armature of the motor-generator and exerts a damping action or braking effect on the driving means for the side rail members.

A further object of the invention is to provide in the loading circuit of the electromechanical control and braking unit novel means for controlling the flow of electrical current in the loading circuit and the resulting force or speed required to rotate the armature of the D.C. motor generator which is embodied in the electromechanical control and braking unit.

Another object of the invention is to provide in the loading circuit of the electromechanical braking or control unit, novel means for overcoming the opposing force of the motor-generator during the operation of rewinding the flexible strap members on the said rail members at the conclusion of the interment.

Another object of the invention is to provide in the new apparatus novel means for enabling the apparatus to be adjusted laterally to accommodate the apparatus to grave openings of varying widths.

Other objects will appear hereinafter.

DESCRIPTION OF THE FIGURES IN THE DRAWINGS

Figure 1:
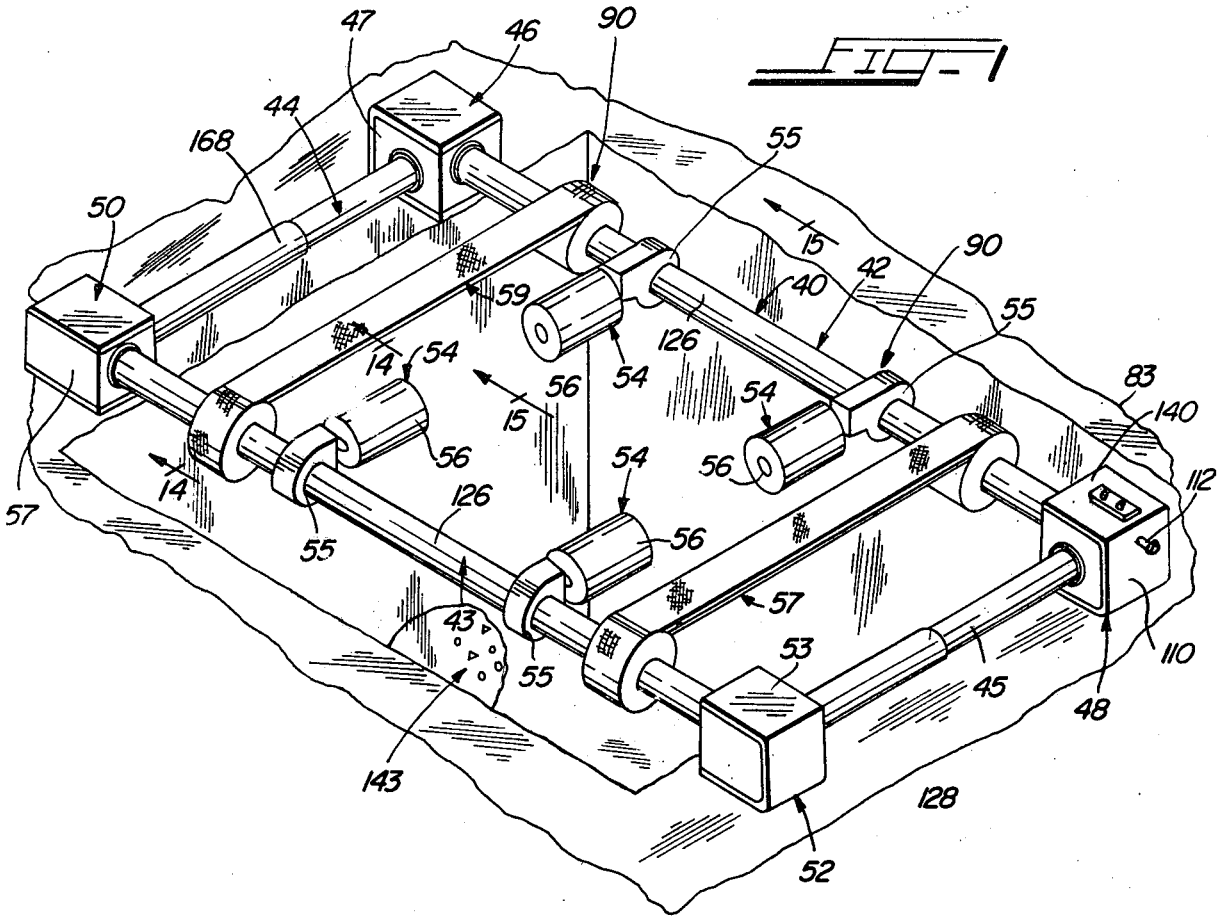
FIG. 1 is a perspective view of the new casket-placer and casket-lowering apparatus positioned over a grave opening.
Figure 30:
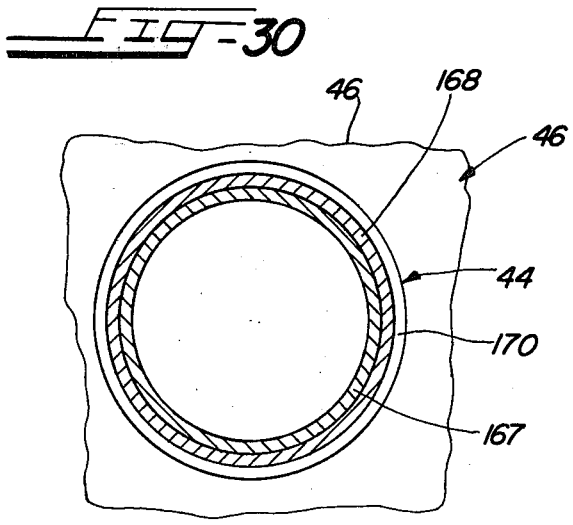
Figures 5, 6:
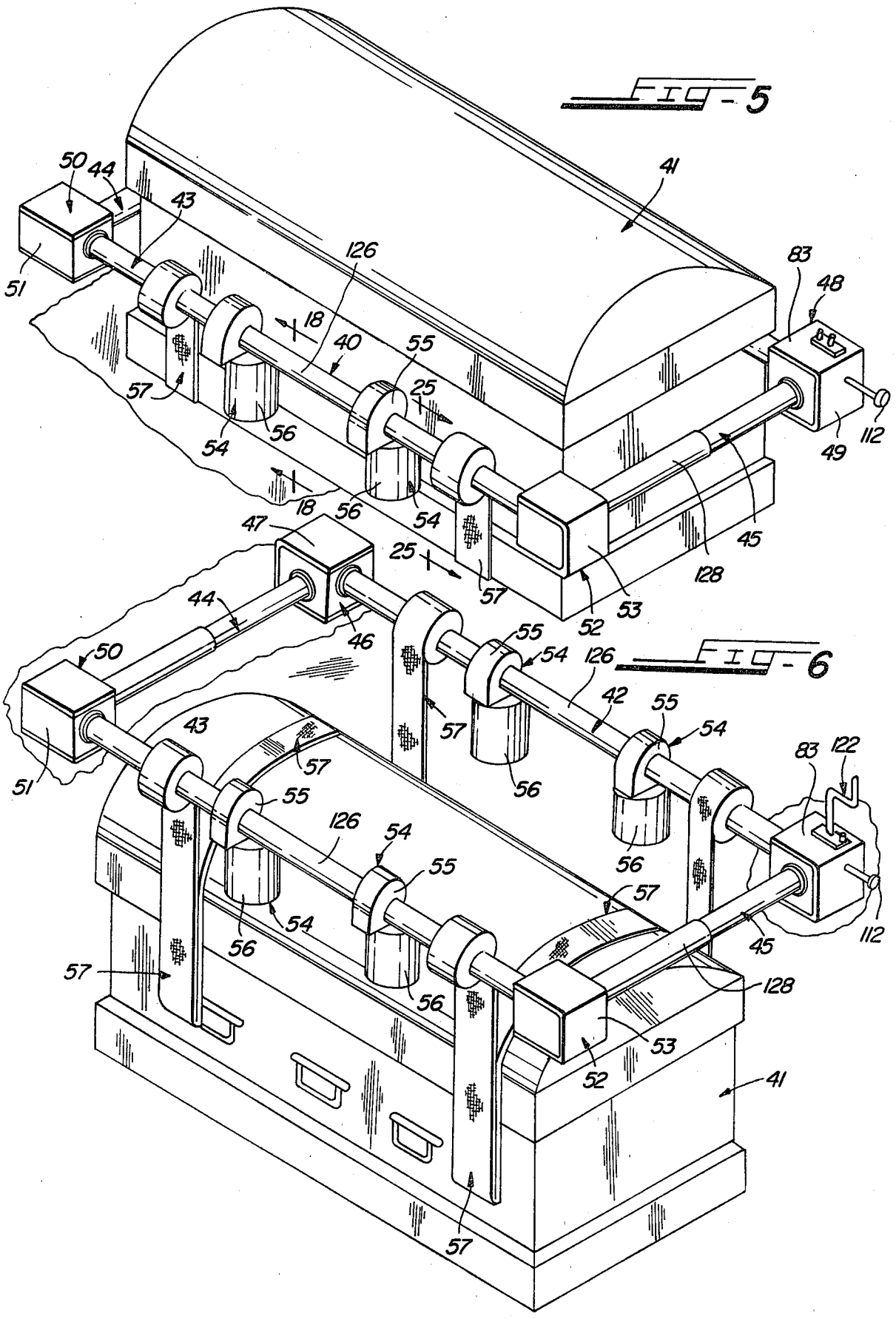
FIG. 5 is a perspective view, similar to FIG. 4, but showing the casket being further lowered into the grave opening, or into the base of a burial vault in the grave opening, on the flexible casket-supporting and lowering strap members.
FIG. 6 is a perspective view showing the casket lowered into the grave opening and the flexible casket-supporting and casket-lowering strap members being removed from below the casket and raised upwardly into a position for reuse.
Figure 25:
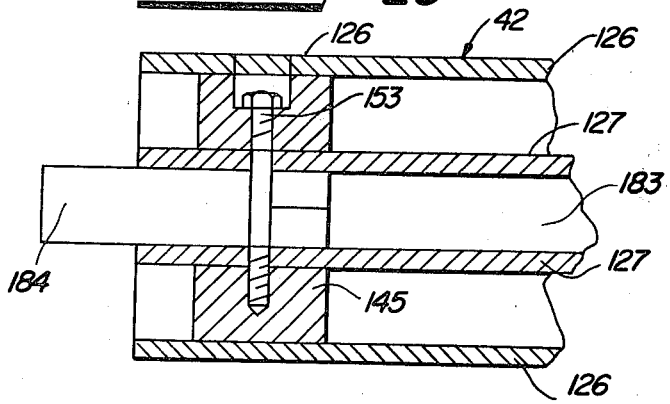
Figure 26:
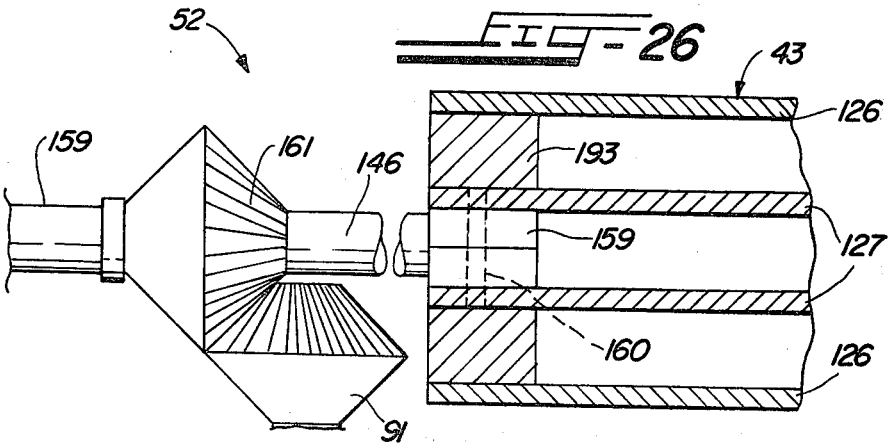
Figure 34:
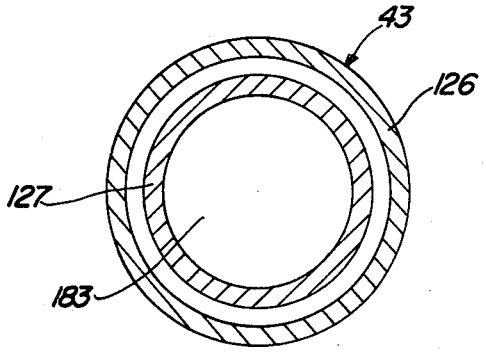
Figure 12:
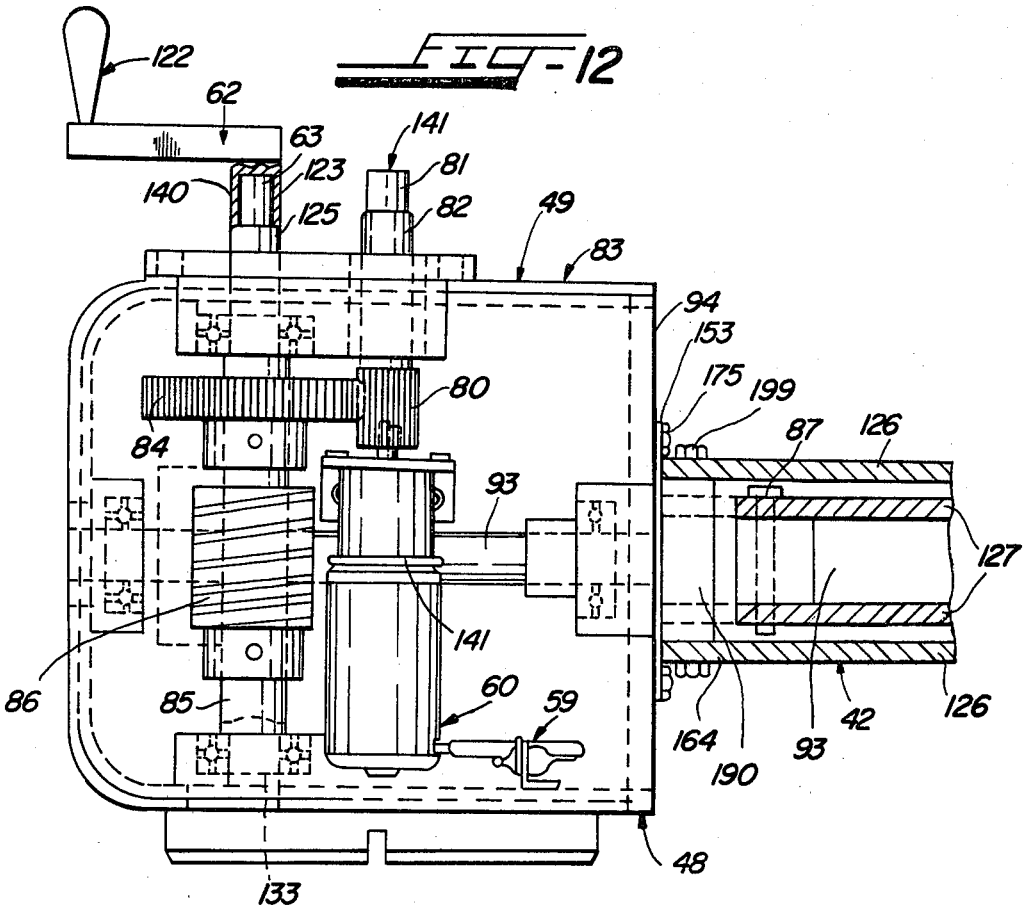
Figure 33:
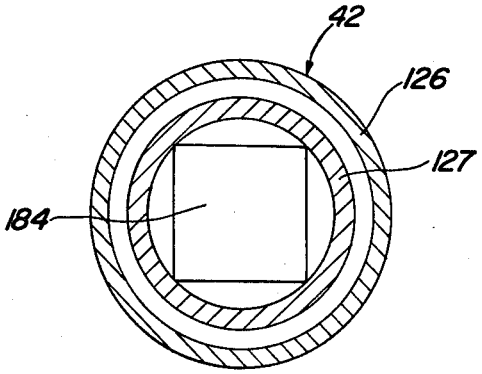
Figure 13:
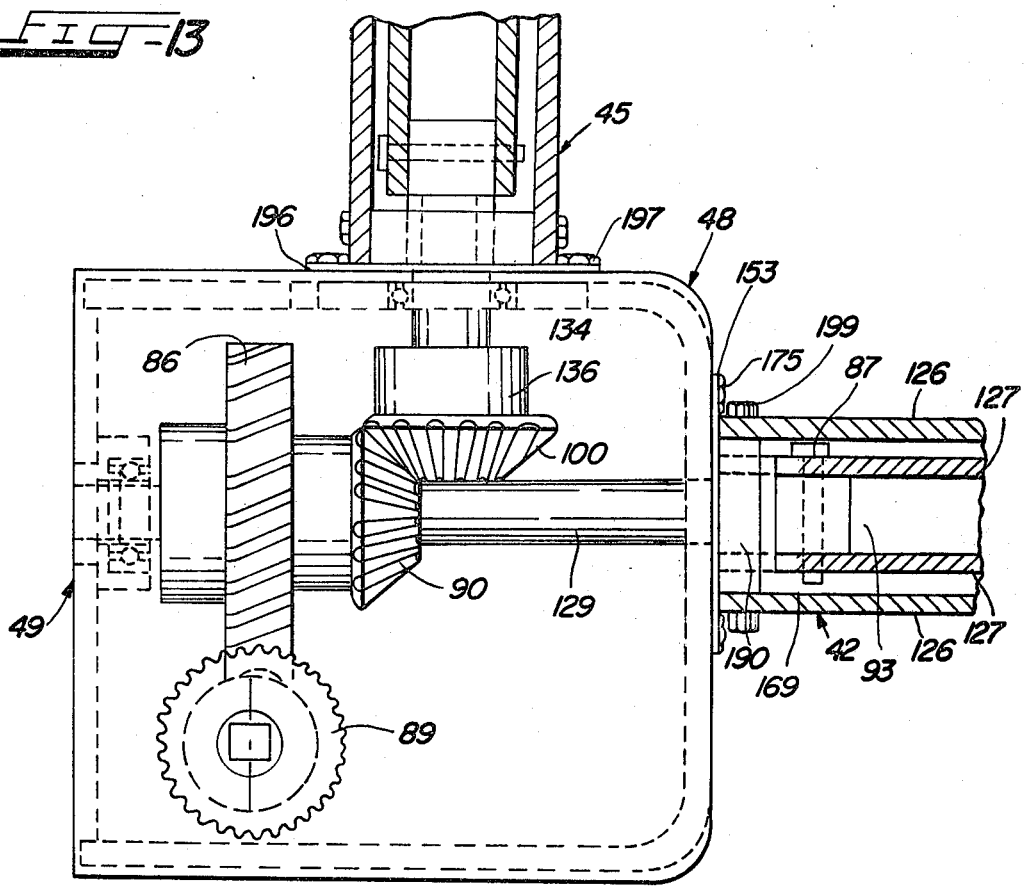
Figure 14:
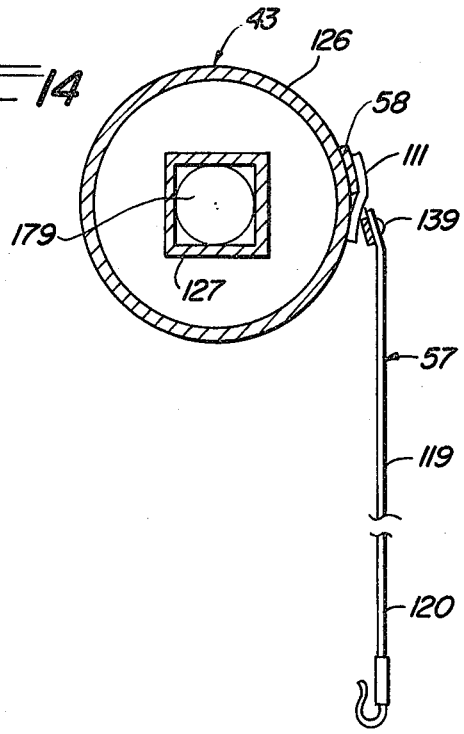
Figure 19:
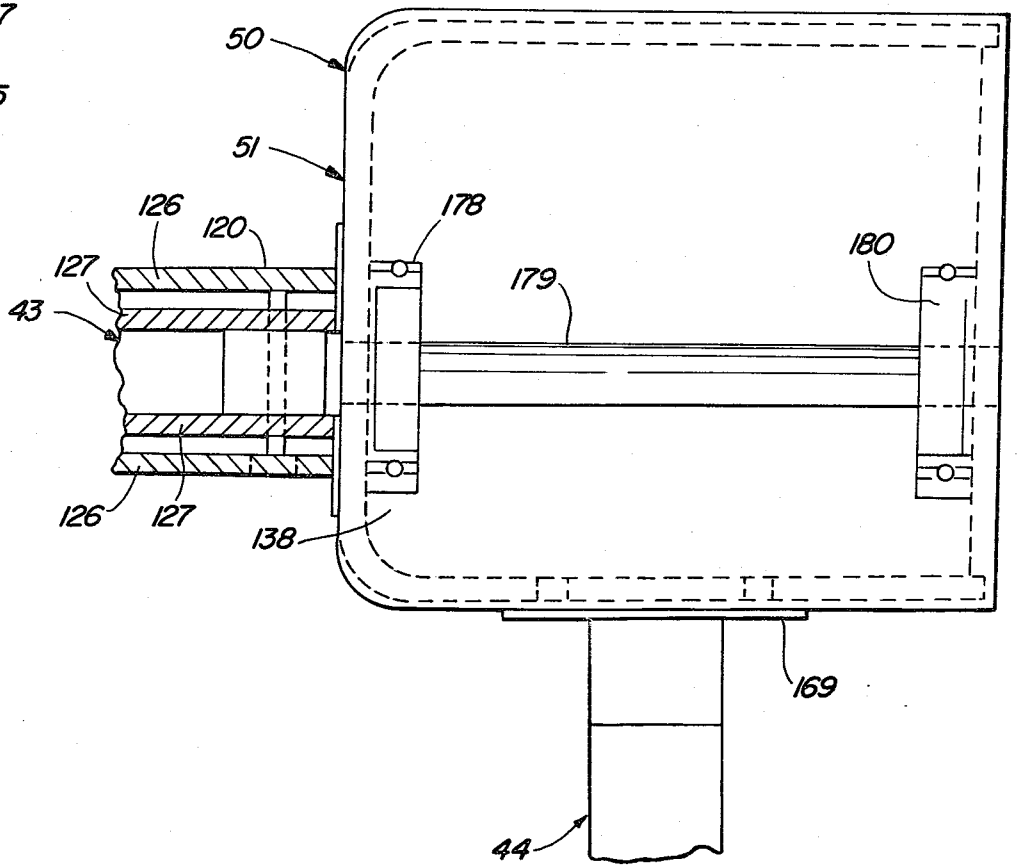
Figure 18:
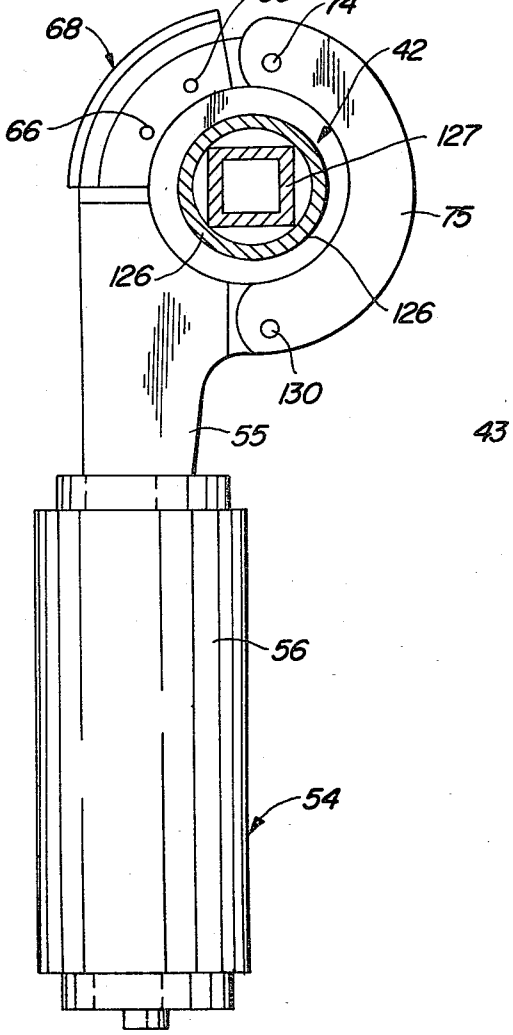
Figure 20:
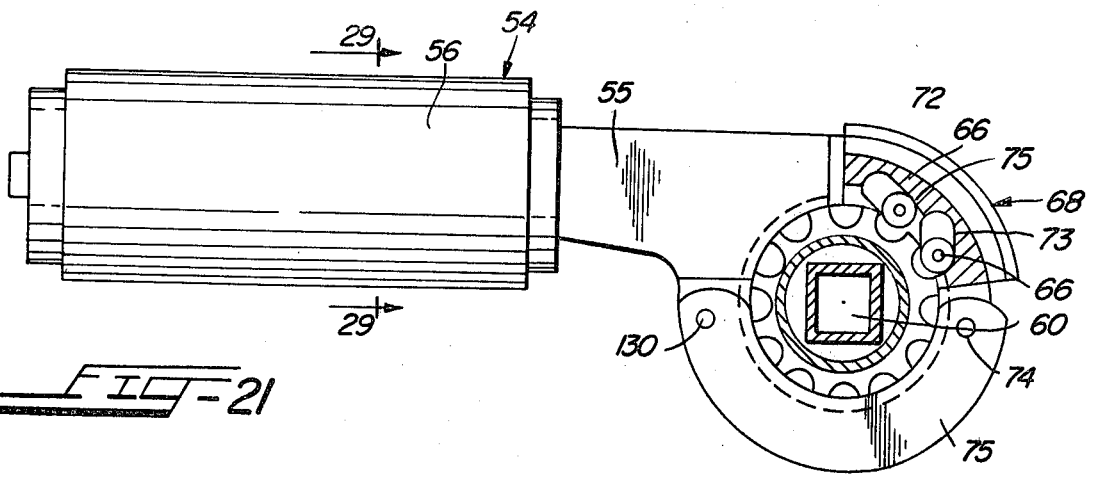
Figure 21:
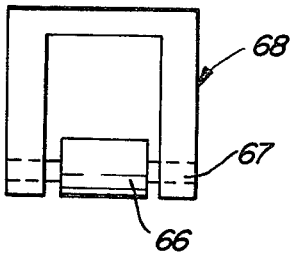
Figure 22:
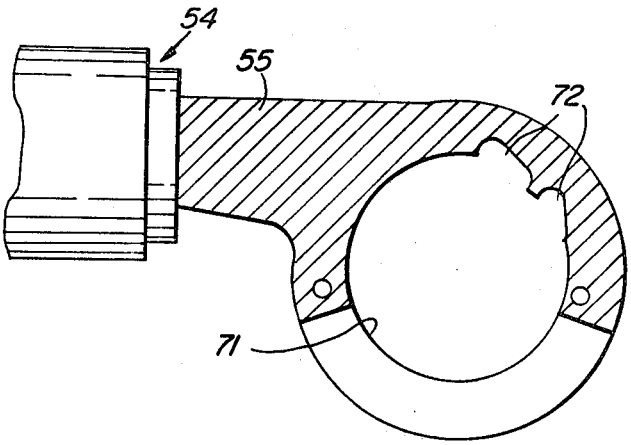
Figure 23:
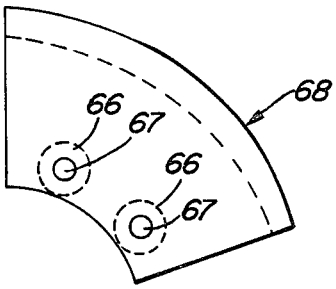
Figure 24:
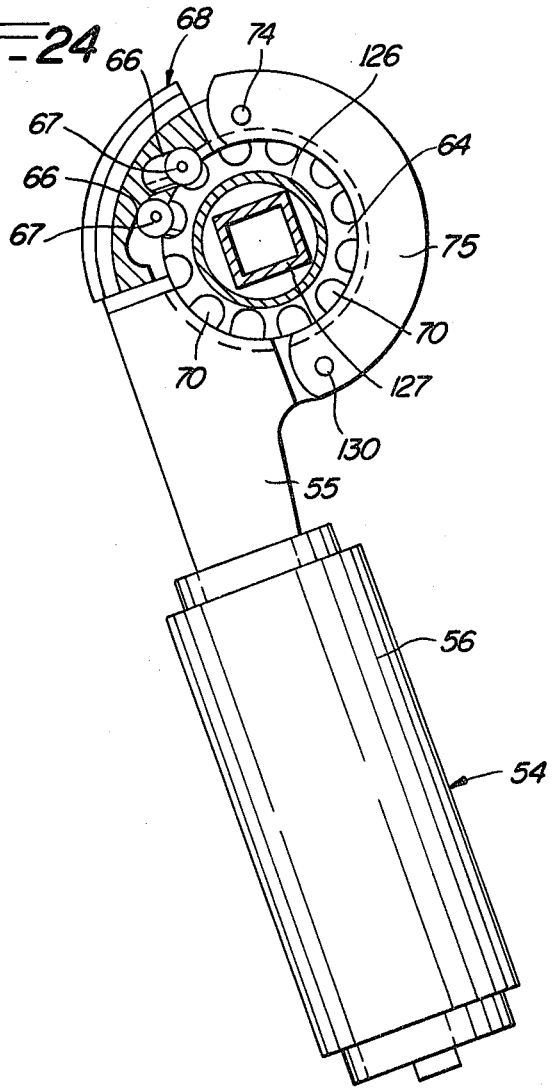
Figure 29:
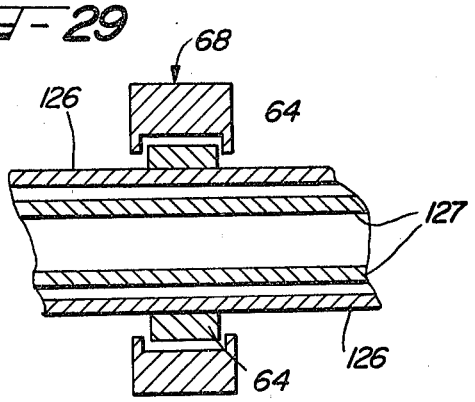
Figure 32:
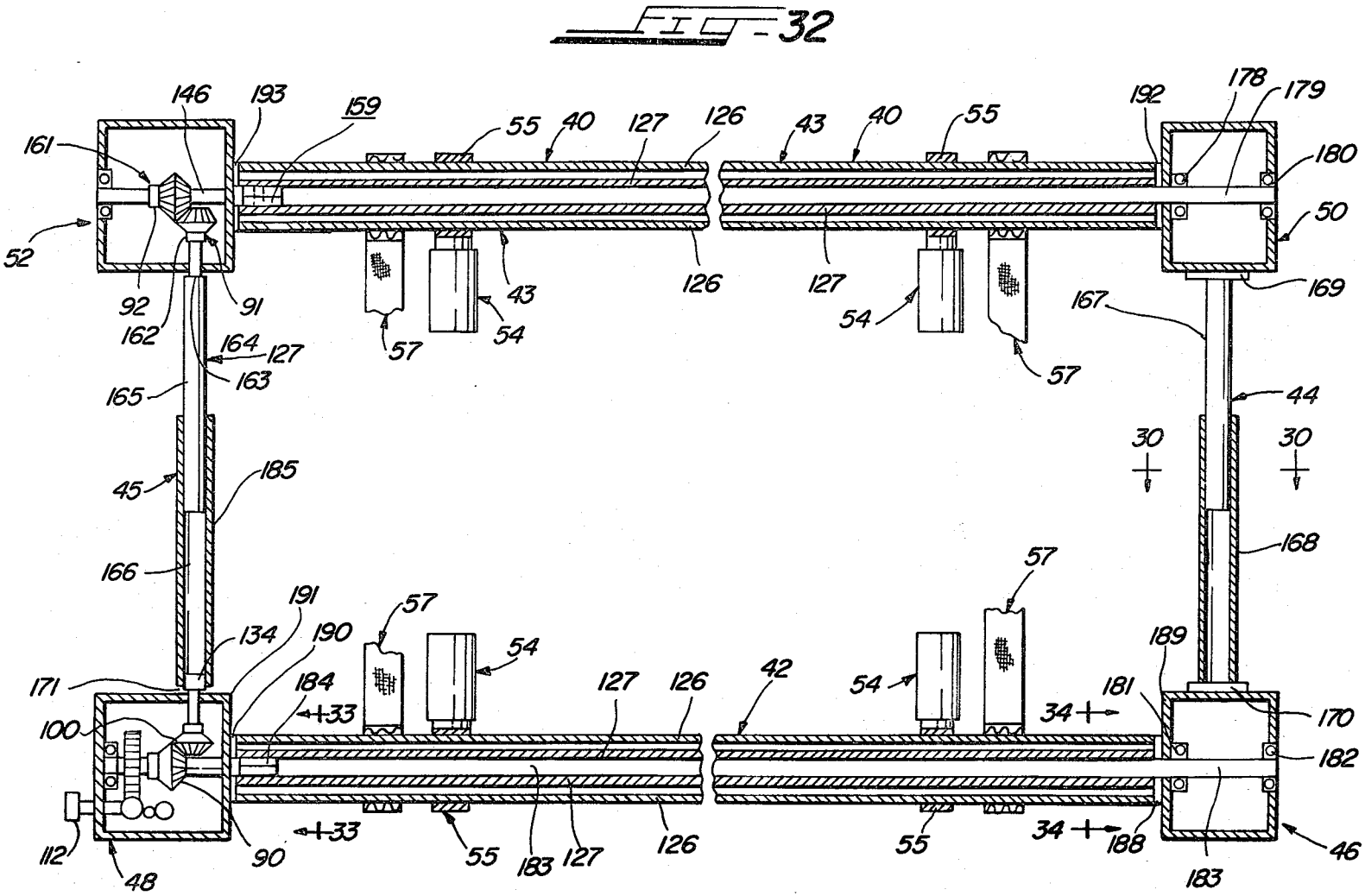

FIG. 12 is an elevational view of parts of the driving means for the rotatable side rail members and the front end rail member and associated parts as embodied in the combination braking means and power transmission unit, and showing the hand crank member engaged with a vertical shaft on the unit for raising the flexible casket-supporting and casket-lowering strap members into raised position after completion of the interment, and also showing an additional manually operable shaft member operatively connected to the driving means for to rotatable side rail members and the front end rail member to rotate the driving means and associated parts prior to the time the casket is placed on the apparatus for a graveside service and interment;

FIG. 13 is an elevational view showing the arrangement of the gear and shaft mechanism in the combination braking and power transmission unit and the connection to one of the side rail members and to the front or head end rail unit;

FIG. 14 is a sectional view on line 14—14 in FIG. 1 of one of the flexible casket-supporting and casket-lowering strap members embodied in the invention as detachably attached to one of the outer cylindrical side rail members;

FIG. 15 is an elevational view, on line 15—15 in FIG. 1, partly in section, of one of the casket-placer and casket-lowering arm members and illustrating parts of the latching device embodied therein;

FIG. 16 is an elevational view of the casket-placer and casket-lowering arm member shown in FIG. 15;

FIG. 17 is a schematic diagram illustrating the electro-mechanical means embodied in the invention, including the electrical loading circuit for controlling and braking the lowering action of the rotatable inner side rail members and associtaed parts for controlling the speed of lowering of the casket into the grave opening;

FIG. 18 is an elevational view, partly in section, on line 18—18 in FIG. 5, of one of the casket-placer and casket-lowering arm members as shown in FIGS. 15 and 16;

FIG. 19 is an elevational view illustrating the construction of one of the idler head units at the lower end of the apparatus and related parts;

FIG. 20 is an elevational view, partly in section, of one of the casekt-placer and casket-lowering arm members, as shown in FIGS. 15, 16 and 18, illustrating parts of the latching means embodied therein, and showing the placer arm latched in horizontal position to a gear member on one of the inner side rail members, two of which gear members are embodied in each of the side rail members;

FIG. 21 is an elevational view of a roller latch control member which forms part of the latching means for the casket-placer and casket-lowering arm members, as shown in FIGS. 15, 16, 18, 19 and 20;

FIG. 22 is a fragmentary sectional view illustrating part of the latching means which is embodied in each of the casket-placer and casket-lowering arm members; as shown in FIGS. 15, 16, 18, 19, 20 and 21;

FIG. 23 is a side elevational view of the latch control roller member shown in FIG. 21;

FIG. 24 is a view partly in elevation and partly in section further illustrating parts of the latching means embodied in each of the casket-placer and casket-lowering arm members, as shown in FIGS. 15, 16, 18, 19, 20, 21, 22 and 23 and showing the placer arm unlatched from the gear member on the side rail members;

FIG. 25 is a sectional view illustrating the construction of the cylindrical shaped outer tubular member and the construction of the inner rectangular in cross section shaped rotatable member which is embodied in each of the side rail members or units and the driving shaft for the rotatable inner side rail members;

FIG. 26 is a fragmentary sectional view illustrating the construction of the shaft and gear mechanism in the front end shaft and gear housing and the connection of the shaft and gear mechanism therein to the inner rotatable member of the adjacent side rail member;

FIG. 27 is an elevational view of one of the outer tubular side rail members and the latching means thereon for detachably latching the flexible strap members to the outer tubular side rail members;

FIG. 28 is an elevational view of one of the flexible strap members and the latching means thereon for detachably latching the flexible strap members to the outer tubular side rail members as shown in FIG. 27;

FIG. 29 is a sectional view on line 29—29 in FIG. 20 showing the mounting of the latch control roller member on one of the placer arms;

FIG. 30 is a sectional view on line 30—30 in FIG. 32 illustrating the construction of one of the laterally adjustable end rail members;

FIG. 31 is an elevational view of the gear member which forms part of the latching means for latching the casket-placer arm on the outer tubular members of the side rail members which are embodied in the new invention;

FIG. 32 is a schematic plan view of the new apparatus showing the arrangement and location of the component parts thereof;

FIG. 33 is a sectional view on line 33—33 in FIG. 32 illustrating the drive shaft for the inner tubular member of one of the side rails embodied in the apparatus; and FIG. 34 is a sectional view on line 34—34 in FIG. 32 illustrating the supporting and bearing shaft for the inner tubular member of the side rail as illustrated in FIG. 33.

GENERAL DESCRIPTION OF THE CONSTRUCTION AND OPERATION OF THE CASKET-PLACER AND CASKET-LOWERING APPARATUS

GENERAL DESCRIPTION OF CONSTRUCTION

The new casket-placer and casket-lowering apparatus, as assembled, is illustrated in the drawings, in which it is generally indicated at 40, and is shown in FIGS. 1 to 6, inclusive, as being arranged over a grave opening "GO" in position for a graveside service and thereafter to lower the casket, as 41, bearing the remains of the deceased, into the grave opening or into the base 143 of a burial vault in the grave opening, for interment.

The casket-placer and casket-lowering apparatus 40 includes a pair of parallel horizontally extending side rail members 42 and 43 and a pair of horizontally extending end rail members 44 and 45. Each of the side rail members 42 and 43 includes an outer rotatable cylindrical member 126 and an inner rectangular in cross section shaped rotatable member 127, FIGS. 14, 15, 18 and 25.

The lower end portion of the rotatable cylindrical outer tubular member 126 of the side rail member 42 is rotatably journaled in a bearing housing 188 which is attached to the idler housing 46 and the front end portion of the tubular member 126 of the side rail member 42 is mounted in a bearing housing 190 which is attached to a side wall 191 of the braking and power transmission housing 48 (FIG. 32), as illustrated in detail in FIGS. 11, 12 and 13, and as will be described more fully hereinafter.

A drive shaft 184, which is square in cross section projects into the square in cross section inner tubular member 127 of the side rail member 42 and is attached by a bolt 153 and collar 145 to the inner tubular member 27 of the side rail 42 (FIG. 25) carries a gear 90 and another and second longer bearing and supporting shaft 183 which is annular in cross section (FIG. 34) projects into and supports the inner tubular member 127 of the side rail member 42 and is rotatably journaled in bearing housings 181 and 182 which are mounted on the inner surfaces of the side rails of the idler housing 46 (FIG. 32).

Similarly, the outer tubular member 126 of the side rail member 43 has one end portion which is rotatably journaled in a bearing housing 193 which is attached to a side wall of the gear housing 52 and the other or lower end portion of the outer tubular member 126 of the side rail 43 is rotatably journaled in a bearing housing 192 which is attached to a side wall of the idler housing 52 (FIG. 32).

A shaft 159, which is square in cross section, carries a gear 161 in the housing 52, projects into the inner square in cross section tubular member 127 of the side rail member 43 and a second longer annular in cross section supporting and bearing shaft 179 projects into the square in cross section tubular member 127 of the side rail member 43 and is rotatably journaled in bearing housings 178 and 180 which are mounted on the inner surfaces of the idler housing 50 (FIG. 32).

As shown in FIG. 26, the shaft 146 is attached by a fastening element 159 to the drive shaft 159 and the inner rotatable member 127 of the side rail 43 is rotatably journaled within the bearing structure 193.

The new casket-placer and casket-lowering apparatus 40 includes four casket-placer arm units 54, two of which are latchingly mounted in spaced relationship on the outer tubular member 126 of each of the side rail members 42 and 43 by means of mounting sleeves 55 each of which is formed as an integral part of the body 56 of each of the casket-placer and casket-lowering arm units 54.

The casket-placer and casket-lowering apparatus 40 also includes a pair of flexible casket-supporting and casket-lowering strap members 57 which are windable onto and off from the rotatable outer members 126 of the side rail units 42 and 43 (FIGS. 1 to 6, inclusive, 14, 27 and 28), as will be described more fully hereinafter.

The combination braking and power transmission head unit 48 includes a housing 49 in which is arranged an electrical circuit 59 which includes a D.C. motor-generator unit 60 which is under control of a gear train 84, 81 and 80 (FIG. 17).

The new casket-placer and casket-lowering apparatus 40 includes means for retrieving and rewinding the flexible casket-supporting and casket-lowering strap members 57 after the completion of the graveside service and interment and this means includes a hand crank member 122 (FIG. 12) which is detachably attachable to a shaft 123 which operates a gear mechanism (FIG. 12) for rewinding the flexible strap members 57 back into their normal position, as in FIG. 1, after the completion of the graveside service and interment.

In the use of the new casket-placer and casket-lowering apparatus 40 the apparatus is positioned over the grave opening "GO" with the three head unit 46, 50 and 52, and the combination braking and power transmission head unit 48 arranged on the ground surface adjacent the four corners of the grave opening.

Figure 2:
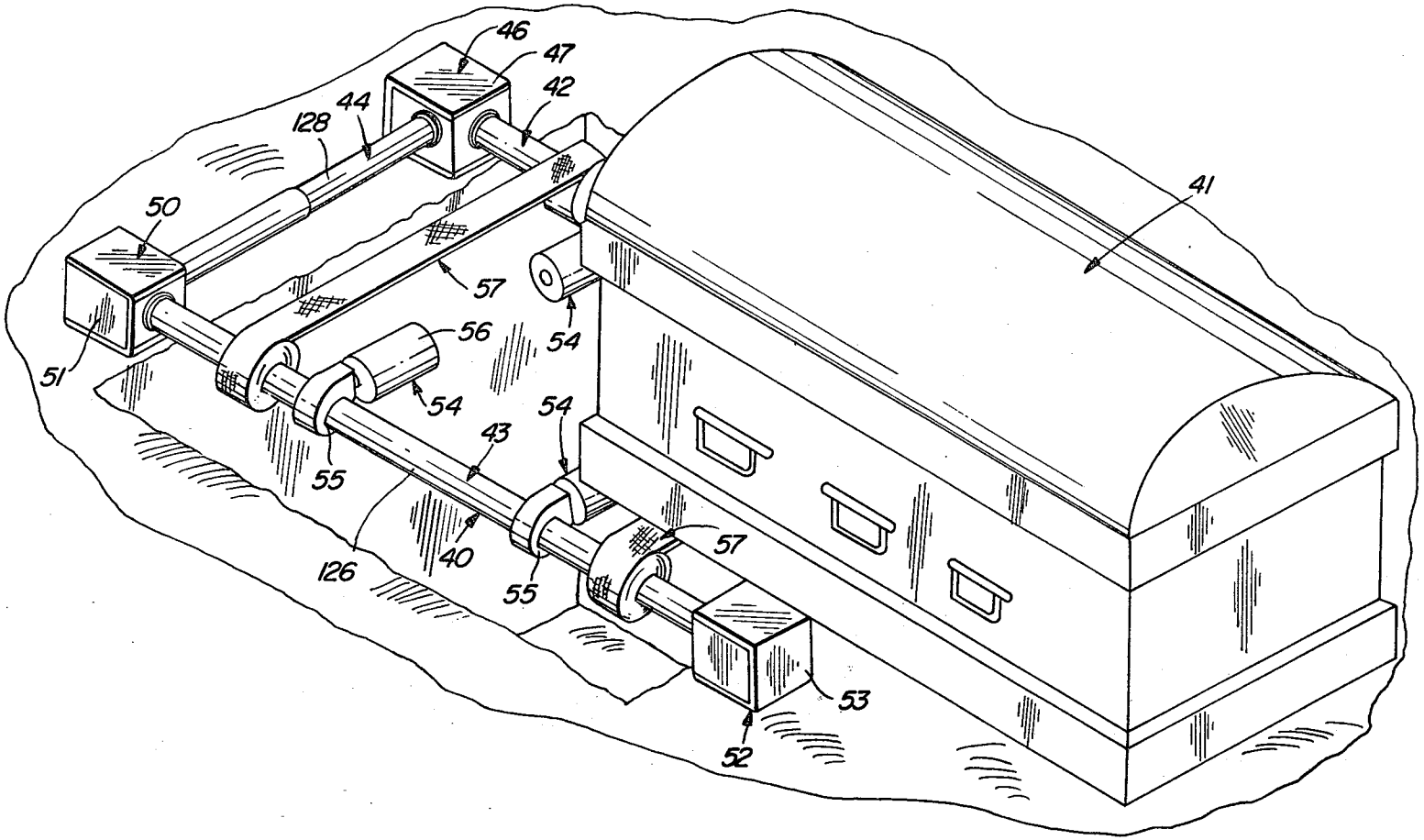
FIG. 2 is a perspective view of the new casket-placer and casket-lowering apparatus arranged over a grave opening and showing a casket being slid endwise onto the apparatus.
Figure 3:
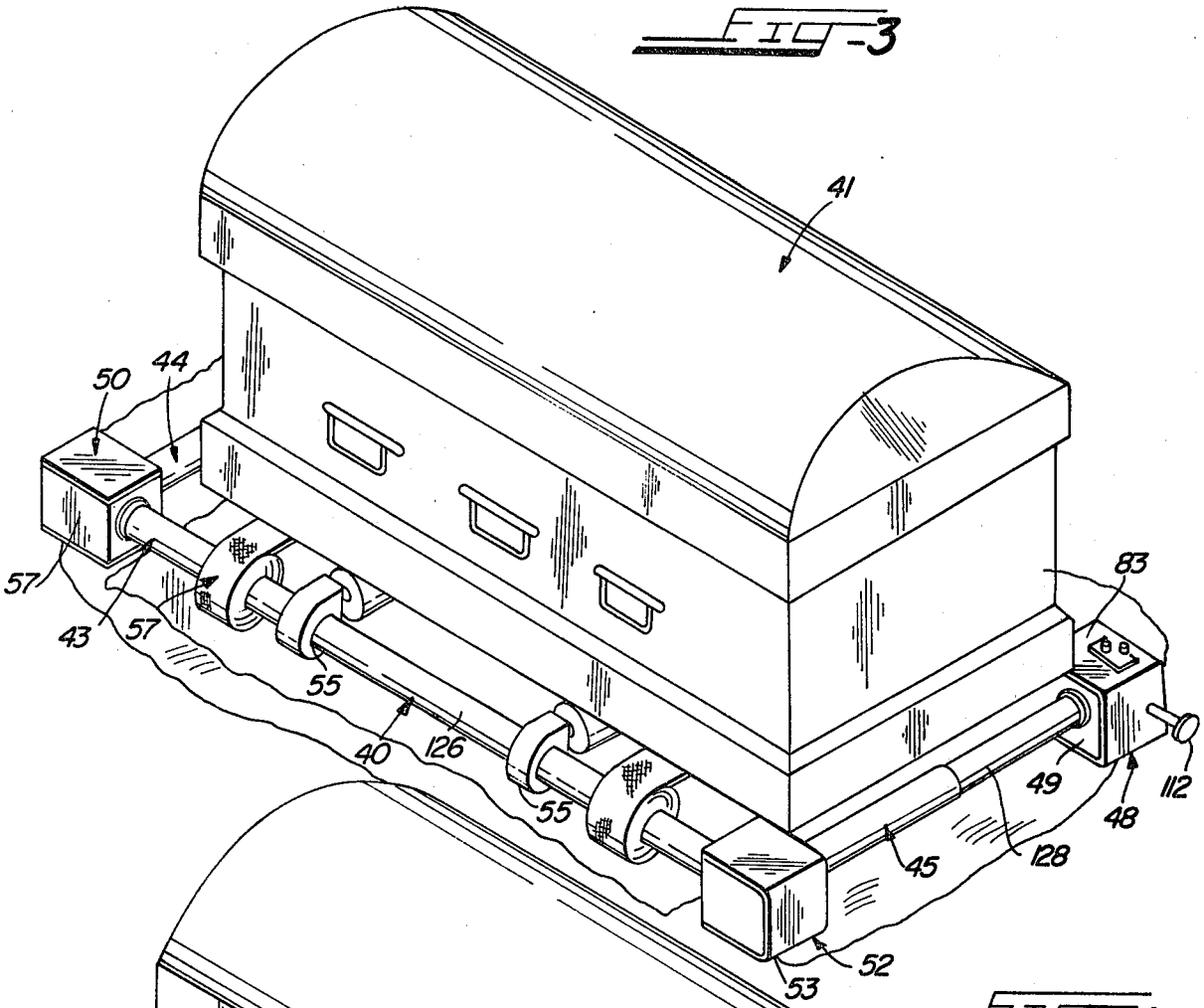
FIG. 3 is a perspective view showing the new casket-placer and casket-lowering apparatus positioned over a grave opening with a casket disposed thereon for a graveside service.

At the commencement of the graveside service the pallbearers lower the casket 41 and slide it endwise, as shown in FIG. 2, onto the casket-placer and casket-lowering apparatus 40 into the position in which it is shown in FIG. 13 and in which the casket 41 rests on the four casket-placer and casket-lowering arm members 54, as shown in FIG. 3. When the weight of the casket 41 bears down on the casket-placer and casket-lowering arm members 54 they rotate the inner rotatable member 127 on which they are latchingly mounted, and also the outer tubular members 126, and during this movement the casket 41 is lowered onto the flexible strap member 57 as the placer arm members 54 become unlatched from the side rail members 126, by latching means which will be described more fully hereinafter, as they pivot downwardly into the generally vertical position in which they are shown in FIGS. 4, 5, 6 and 24, and thereby shifting the weight of the casket 41 onto the flexible strap-supporting and strap-lowering members 57.

When the weight of the casket 41 is thus shifted onto the flexible casket-supporting and casket-lowering strap members 57 the strap members 57 are unwound from the oppositely rotating outer tubular side rail members 126 as the casket 41 is lowered into position in the grave opening "GO" as shown in FIG. 6. During this operation the outer rotatable tubular members 126 rotate and the flexible strap members 57 are thus unwound from the outer tubular side rail members 126 and as the casket 41 is lowered into the grave opening.

As the casket 41 is thus lowered into the grave opening the rotatable inner tubular members 127 of the side rail members 42 and 43 act, through the drive shaft 184 and the gear mechanism in the combination braking and power transmission head 48 (FIGS. 7, 11 and 12), and the drive shaft 159 and the shaft and gear mechanism in the housing 52 and the front end rail member 45 to rotate the D.C. motor generator 60, thereby energizing the electrical circuit 59 and the motor generator 60 and related parts in the electrical control circuit 59 (FIG. 17). The rotation of the armature of the D.C. motor generator 60 creates an electrical current in the loading circuit 69 (FIG. 17) which acts to control and brake the speed of the descending motion of the casket 41 into the grave opening, or into the base of a burial vault 143 (FIG. 1) in the grave opening, as will be described more fully hereinafter.

After the completion of the graveside service and interment, the flexible casket-supporting and casket-lowering strap members 57 may be removed or released from under the casket 41 and rewound back into their normal pre-interment position on the outer tubular side rail members 126, as in FIG. 1, by means of the hand crank members 122-62 and associated shaft and gear mechanism (FIG. 12), as will be described more fully hereinafter.

DETAILED DESCRIPTION OF THE VARIOUS COMPONENTS OF THE CASKET-PLACER AND CASKET-LOWERING APPARATUS 40

THE CASKET-PLACER AND CASKET-LOWERING ARM MEMBERS 54 (FIGS. 1, 2, 3, 4, 5, 6, 15, 16, 18, 20, 21, 22, 23, 24 and 32)

Each of the casket-placer and casket-lowering arm members 54, as shown in FIGS. 1, 2, 3, 4, 5, 6, 15, 16, 18, 20, 21, 22, 23, 24, and 32, includes a gear 64 which is rigidly attached to one of the inner rotatable side rail members 127 (FIGS. 20 and 24).

The gear 64 is provided on its peripheral surface with a series of notches or grooves 65 providing teeth 150 in the gear 64 which are adapted to be engaged by a pair of rollers 66 which are rotatably mounted, as at 67, in a latch control member 68 which is movably mounted in the body 55 of the casket-placer and casket-lowering arm member 54 (FIG. 29). The body 55 of the casket-placer and casket-lowering arm member 54 has a series of radially outwardly projecting slots or grooves 73 formed in its internal peripheral surface 71 (FIG. 20). In addition, the body 55 of the casket-placer and casket-lowering arm member 54 is provided with a second set of radially outwardly projecting slots 72 which are formed in the internal peripheral surface 71 of the body 55 of the casket-placer and casket-lowering arm member 54, and these slots 72 are arranged radially outwardly of the first set of slots 73 (FIGS. 20 and 22). As shown in FIGS. 15, 20 and 24, the body 55 of the casket-placer and casket-lowering arm member 54 includes a lower section 75 which is hingedly attached, as at 74, to the body 55 of the casket-placer and casket-lowering arm member 54.

As shown in FIGS. 15 and 20, a latch pin hole 130 is provided in the member 75 and extends through the body 55 of the arm member 54 and a manually operable handle-bearing latch pin 131 is extended through the hole 130 so as to releasably latch the hinged member 75 to the body 55 of the arm member 54.

In the use of the casket-placer and casket-lowering arm members 54 the latch control member 68 causes the rollers 66 to be pinched between the gear 64 and the radially inner slots 73 in the body 55 of the casket-placer and casket-lowering arm member 54, thereby latching the casket-placer and casket-lowering arm member 54 in a horizontal position on the outer members 126 of the side rail members 42 and 43. However, as the rotatable outer side rail members 126 of the side rails 42 and 43 are rotated during the casket lowering operation, the casket-placer and casket-lowering arm members 54 are moved from their original horizontal position, as shown in FIG. 24. At this point the weight of the body 55 of the casket-placer and casket-lowering arm member 54 and the pinching action thereof on the rollers 66 is greatly reduced with the result that the weight of the latch control member 68 pulls the rollers 66 out of the radially inner slots 73 and into the radially outer slots 72 which are formed in the inner peripheral surface 71 of the body 55 of the casket-placer and casket-lowering arm member 54, so that the parts are disposed in the unlatched position in which they are shown in FIG. 24. In this position of the parts, as shown in FIG. 24, the teeth 150 of the gear 64 will not reach or engage the rollers 66 on the latch control member 68 and the outer rotatable members 126 of the side rails 42 and 43 will rotate freely and independently of the casket-placer and casket-lowering arm members 54 which will remain in a generally vertical position until the lower section 75 is unhinged from the body 55 of the arm member 54 by removing the latch pin 131. The casket-placer and casket-lowering arm members 54 may then be removed from the side rails 42 and 43 at the conclusion of the graveside and interment service.

In the meantime, the weight of the casket 41 is transferred to the flexible casket-supporting and casket-lowering strap members 57 by which the casket 41 is further lowered into the grave opening, or into the base 143 of a burial vault, for interment.

THE CONSTRUCTION AND OPERATION OF THE COMBINATION BRAKING AND POWER TRANSMISSION HEAD UNIT AND THE BRAKING MECHANISM THEREIN FOR CONTROLLING THE SPEED OF LOWERING THE CASKET 41 (FIGS. 1, 3, 5, 6, 7, 11, 12 AND 17)

The new casket-placer and casket-lowering apparatus 40 includes the combination braking and power transmission head unit 48 which is arranged within the housing 49 and includes a novel electronically controlled braking mechanism for controlling the speed of lowering of the casket 41 into the grave opening, or into the base 143 of a burial vault in the grave opening, first by means of the casket-placer and casket-lowering arm members 54, and then by means of the flexible casket-lowering strap members 57. To this end the combination braking and power transmission head includes the electronically controlled braking circuit 59 (FIG. 17) which includes the D.C. motor generator 60, which may be of any suitable type and design, but for which a 24 volt D.C. motor generator manufactured by TRW, Inc. and known as its Part No. 409A270-3 has been found to be well suited.

In addition, the electronically controlled braking circuit 59 includes a diode 76, which may be of any suitable type and design, but for which a diode manufactured by the General Electric Company and known as its No. 1N1200A has been found to be well suited.

The electronically controlled braking circuit 59 also includes a ZENER diode 77, which may be of any suitable type and design, but for which a ZENER diode manufactured by Motorola and known as its No. 1N12206a has been found to be well suited.

Figure 7:
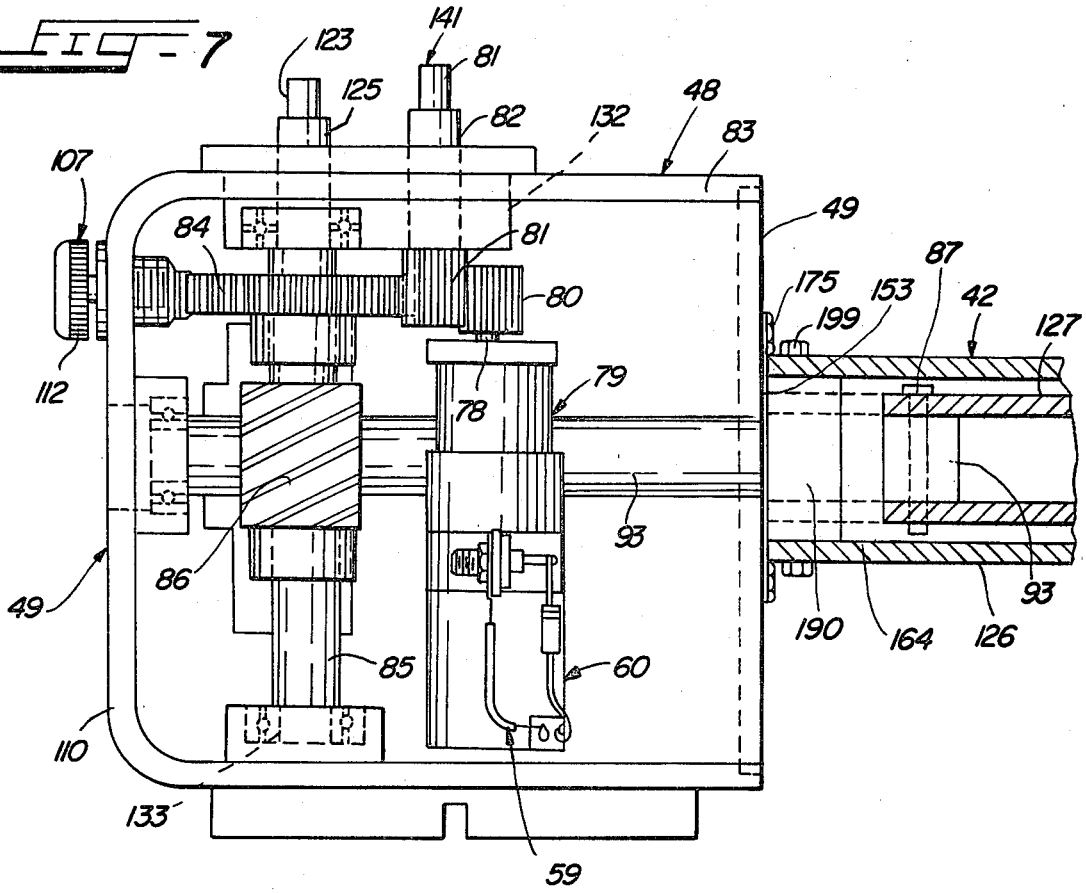
FIG. 7 is an elevational view of the combination braking and power transmission head unit showing the power driven gear train or driving means for the rotatable inner side rail members and associated parts and showing such parts latched against operation by the manually operable latching device therefor which is embodied in the invention.
Figure 8:
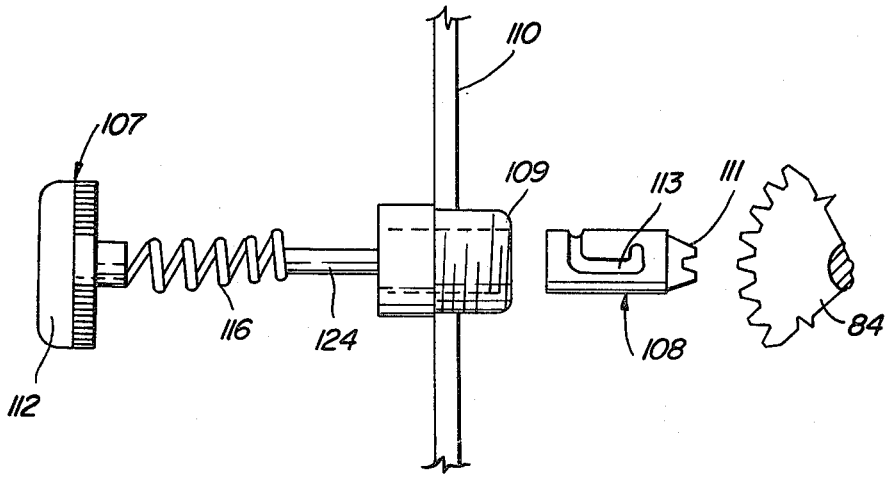
FIG. 8 is an exploded view of the manually operable latching device for the driving means for the inner side and end rail members and associated parts.

As shown in FIG. 7, the power shaft 78 of the D.C. motor generator 60 is operatively connected to a speed reducing gear train unit 79 which, in turn, is operatively engaged with a pinion gear 80 which meshes with a pinion gear 81 on a shaft 82 which is rotatably mounted in a bearing housing 132 which is mounted on the inner side of a side wall 83 of the combination braking and power transmission head housing 49 (FIG. 7). The pinion gear 81 on the shaft 72 meshes with a spur gear 84 which is mounted on a vertical shaft 85 which is mounted in a bearing housing 133 which is mounted on the inner side of the housing 49 (FIG. 7), and the spur gear 84 rotates a worm gear 86 which is also mounted on the vertical shaft 85 (FIGS. 7 and 11).

Figure 11:
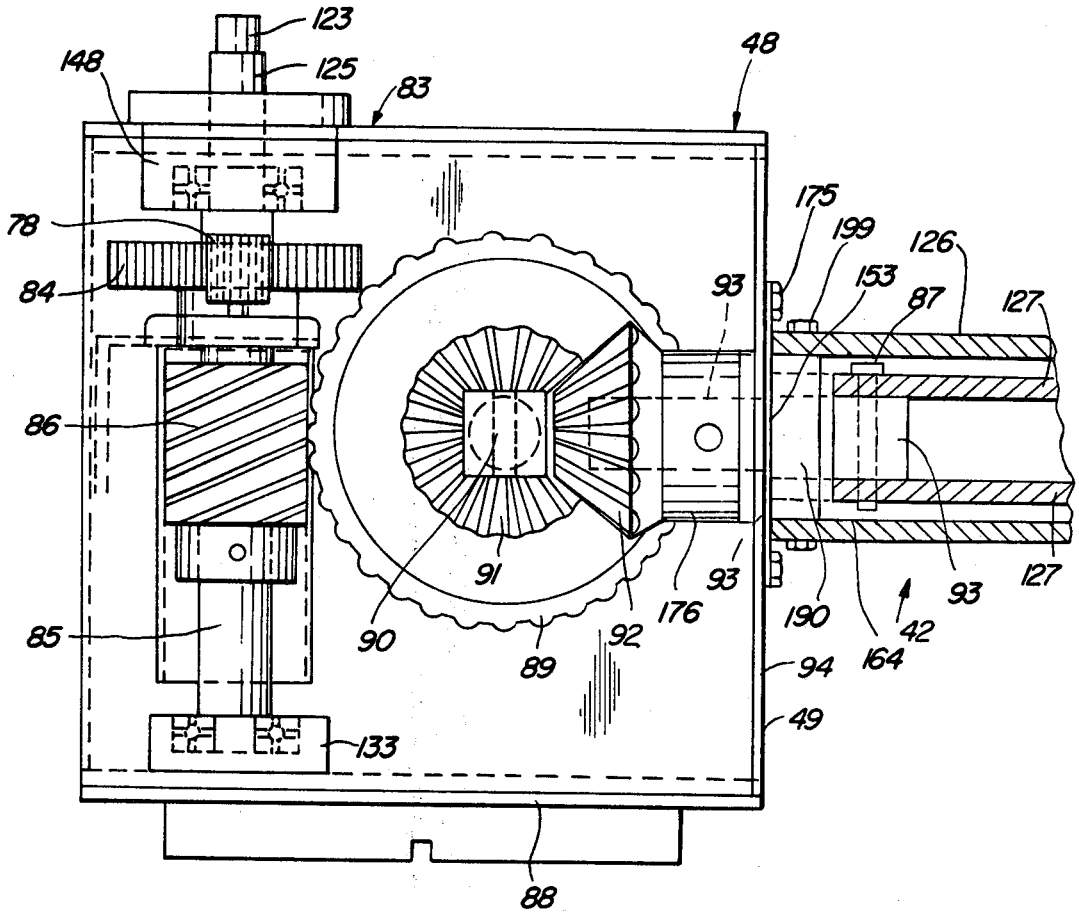
FIG. 11 is a view partly in section and partly in elevation of the parts of the driving means for the rotatable side and the front end rail member and associated parts as embodied in the combination braking means and power transmission unit.

The worm gear 86 on the vertical shaft 85 meshes with a worm gear 89 which is mounted on a shaft 90 which also carries a miter gear 91 which meshes with a second miter gear 92 which is mounted on a shaft 93 on which a collar 176 is mounted and the shaft 93 which extends through a side wall 94 of the housing 49 and is rotatably journaled in a bearing structure 190 which is attached to a support bracket 153 which, in turn, is attached by screws 175 to a side wall 94 of the housing 49 of the combination braking and power transmission head 48 (FIGS. 11, 12 and 13). The shaft 93 is attached to the inner rotatable member 127 of the side rail 42 by means of a fastening element in the form of a bolt 87 and the outer tubular member 126 is rotatably journaled in the ball race of a bearing structure to which it is attached by fastening means 199 (FIGS. 11, 12 and 13).

In the use and operation of the new casket-placer and casket-lowering apparatus 40, when the casket 41 is first placed on the casket-placer and casket-lowering arm members 54 and then later on the flexible strap members 57, the weight of the casket 41 on the casket-placer and casket-lowering arm members 54 causes the inner side rail members 127 of the side rails 42 and 43 and their drive shafts 184 and 159 and their supporting and bearing shafts 183 and 179 to rotate and this action is first transmitted by the placer arms 54, and then, when the weight of the casket 41 is transmitted to the flexible strap members 57, this action is transmitted through the inner square in cross section tubular members 127 of the side rail members 42 and 43 through shaft 146, gears 91 and 92 in the housing 52, and the parts of the front end rail 45, gears 100 and 90 in the housing 49 (FIG. 32), shaft 93, gear 92, gear 91, shaft 90, gear 89 to 86, shaft 85, gears 84, 81 and 80, to the shaft 78 of the motor generator 60, thereby rotating the armature of the D.C. motor generator 60 and creating a preset threshold electrical current voltage in the electronic braking and loading circuit 59 which acts to brake and control the lowering speed of the casket 41, first on the casket-placer and casket-lowering arm members 54 and later on the flexible strap members 57.

As pointed out above, the rotational movement of the armature of the D.C. electric motor generator 60 creates a voltage in the electronic braking and loading circuit 59 (FIG. 17) and as the speed of rotation of the rotatable inner side rail members increases, as the casket 41 is lowered into the grave opening, or into the base 143 of a burial vault, the speed of rotation of the armature of the D.C. electric motor generator 60 increases correspondingly. During this time the flow of electric current through the electronic braking circuit 59 increases and exerts a braking action to prevent the lowering speed of the rotatable inner side rail members 127 from overaccelerating, thereby creating a braking action on the speed of the lowering action of the casket 41. This control is accomplished by the ZENER diode 77 due to the fact that the electric motor generator 60 works on a dynamic braking principle as a generator or alternator, that is, the greater the load the greater the turning force or speed required to turn its armature can thus be controlled. To this end the electronic braking circuit 59 incorporates the ZENER diode 77 which is a semi-conductor device which will allow no electrical flow in one direction in the circuit 59 until a predetermined threshold voltage is reached, but at that point the ZENER diode 77 will conduct electricity. The selection of the threshold voltage determines the speed at which the armature of the motor generator 60 will rotate.

Since the output voltage of a generator is related to its armature speed, by controlling its output voltage the new casket-placer and casket-lowering apparatus 40 is able to control the armature speed of the motor generator 60 and hence the lowering speed of the casket 41. Thus, the function of the ZENER diode 77 is to regulate the voltage provided by the motor generator 60 in the electronic braking and loading circuit 59. Below the predetermined threshold voltage level of the ZENER diode 77 the braking effect, or regulation provided by the motor generator 60 is zero, neglecting function. As the inertia of the lowering casket 41 increases, it tends to turn the armature of the motor generator 60 at a speed greater than that which will produce the predetermined threshold voltage. However, above the threshold voltage, the terminals of the generator "see" a short circuit and the current in the windings increase until the braking effect on the armature by the permanent magnets is sufficient to keep the armature at the speed which will produce the threshold voltage

THE CONSTRUCTION AND OPERATION OF THE MANUALLY OPERABLE LATCHING MEANS FOR LATCHING THE COMBINATION BRAKING AND POWER TRANSMISSION HEAD UNIT AGAINST MOVEMENT (FIGS. 7, 8, 9 AND 10)

Figure 9:
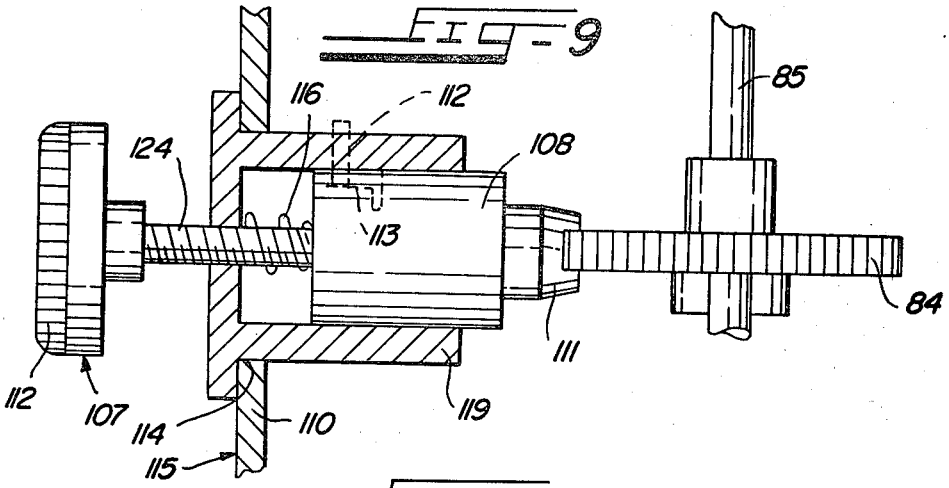
FIG. 9 is a view partly in section and partly in elevation of the manually operable latching device for the driving means for the rotatable side rail members and the front end rail members and related parts and showing such parts in latched position.
Figure 10:
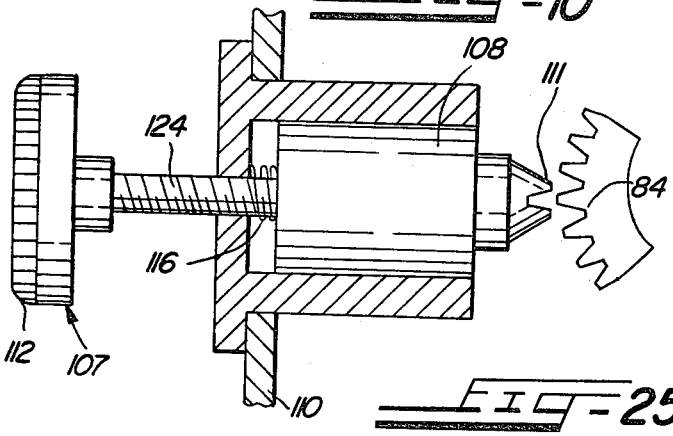
FIG. 10 is a fragmentary sectional view of the latching device for the driving means for the rotatable side and the front end rail member, as shown in FIG. 9, and showing such parts in unlatched position.

The new casket-placer and casket-lowering apparatus 40 includes manually operable latching means, shown in FIGS. 7, 8, 9 and 10, for latching the combination braking and power transmission head unit and its operating mechanism against movement until such time as the funeral director is ready to proceed with the interment of the casket 41 after the completion of the graveside service. This latching means is shown in FIGS. 7, 9 and 10, in which it is generally indicated at 107, and includes a generally cylindrical latching plunger 108 which is slidably mounted in a housing 109 which is mounted on a side wall 110 of the power head housing 49. The latching plunger 108 has a notched latching inner end portion 111 formed thereon which is adapted to latchingly engage the teeth of the spur gear 84 on the shaft 85, the parts being shown in latched position in FIGS. 7 and 9. The latching plunger 108 is slidably mounted and guided in the housing 108 by a pin 112 which is mounted on a wall of the housing 109 and has a lower and inner end portion which extends into and works in a slot 113 in the latching plunger 108. The latching means 107 includes a manually operable latch knob or handle member 112 which is mounted on a shaft 124 which is slidably mounted in an opening 114 which is formed in a wall 115 of the housing 109. The inner end portion of the shaft 124 is attached to the latching plunger 108 and a coil spring 116 is mounted on the inner end portion of the shaft 124 between the latching plunger 108 and the wall 115 of the housing 108 (FIGS. 1 and 10).

In the use of the new casket-placer and casket-lowering apparatus 40, the coil spring 116 urges the latching plunger 108 into position to latchingly engage the latching inner end portion 111 thereof into latching engagement with the teeth of the spur gear 84, as shown in FIG. 10, thereby latching the combination braking and power transmission unit 48 and its operating mechanism including the D.C. electric motor generator 60 against rotational movement until such time as the funeral director is ready to lower the casket 41 into the grave oopening, or into the base 143 of a burial vault, after completion of the graveside service.

When the funeral director is ready to lower the casket 41 into the grave opening, or into the base 143 of a burial vault, after completion of the graveside service, he manually retracts the latching plunger 108 outwardly by means of the handle knob 112 and shaft 113, against the action of the coil spring 116, from the latched position in which it is shown in FIGS. 7 and 9 into unlatched position, as shown in FIG. 10. The handle knob 112, shaft 113 and latching plunger 108 are then manually turned a quarter of a turn, clockwise, as seen looking from the left hand end in FIG. 9, thereby moving the latching inner end portion 111 of the latching plunger 108 out of latching engagement with the teeth of the spur gear 84 and thus freeing the combination braking and power transmission head unit and its operating mechanism including the D.C. motor generator 60 and related parts for operational movement.

THE CONSTRUCTION OF THE FLEXIBLE CASKET-SUPPORTING AND CASKET-LOWERING STRAP MEMBERS (FIGS. 1, 2, 3, 4, 5, 6, 14, 27, 28, 31 AND 32)

The construction of the flexible casket-supporting and lowering strap members 57 is shown in FIGS. 1, 2, 3, 4, 5, 6, 14, 27, 28, 31 and 32, and is such that they may be manually detached from the outer tubular members 126 of the side rail members 42 and 43 raised up out of the grave opening after the completion of the graveside and interment services or they may be rewound onto the outer tubular members 126 of the side rail members 42 and 43 should it be necessary to do so at any time during the graveside or interment services.

To this end each of the outer tubular members 126 has a pair of laterally spaced latching elements 111 rigidly mounted on its peripheral surface, as by welding, and one end portion 139 of each of the flexible strap members 57 is detachably attached to the latching elements 111, as shown in FIGS. 14, 27 and 28. This is accomplished by means of a pair of rectangular-shaped holes or openings 142 which are formed in the end portion 139 of each of the flexible strap members 57 and into each of which one of the latching elements 11 is inserted (FIGS. 14, 27 and 28).

After the completion of the graveside and interment services, the flexible casket-supporting and lowering strap members 57 may be manually detached from the outer tubular members 126 of the side rail members 42 and 43, and from the latching elements 111 and raised up over the casket 41, as shown in FIG. 6. However, as pointed out above, the flexible strap members 57 may be rewound onto the outer tubular members 126 of the side rail members 42 amd 43 at any time during the graveside or interment services, should it be necessary to do so to raise the casket 41, as will now be described.

THE MEANS FOR MANUALLY REWINDING THE FLEXIBLE CASKET-SUPPORTING AND CASKET-LOWERING STRAP MEMBERS 57 ONTO THE OUTER TUBULAR MEMBERS 126 OF THE SIDE RAIL MEMBERS 42 AND 43 AFTER THE COMPLETION OF THE GRAVESIDE AND INTERMENT SERVICES AND FOR MANUALLY RAISING THE CASKET DURING THE GRAVESIDE OR INTERMENT SERVICE, IF AND WHEN NECESSARY (FIGS. 7, 11 AND 12)

The new casket-placer and casket-lowering apparatus 40 includes means for manually rewinding the flexible casket-supporting and casket-lowering strap members 57 onto the outer tubular members 126 of the side rail members 42 and 43 after the completion of the graveside and interment services and for manually raising the casket 41 during the graveside or interment service if and when it becomes necessary to do so, as will now be described.

THE MEANS FOR RETRIEVING AND REWINDING THE FLEXIBLE STRAP MEMBERS 57 ONTO THE OUTER TUBULAR MEMBERS 126 OF THE SIDE RAIL MEMBERS 42 AND 43 AFTER COMPLETION OF THE GRAVESIDE AND INTERMENT SERVICES (FIGS. 7, 11, 12 AND 32)

The means for retrieving or rewinding the flexible strap members 57 onto the outer tubular members 126 of the side rail members 42 and 43, after completion of the graveside and interment services, is shown in FIGS. 7, 11 and 12, wherein it is generally indicated at 112 and includes a manually operable hand crank member 62 which includes an arm 123 having a squared slot 140 thereon so that the arm 123 of the hand crank member 62 may be detachably mounted on the squared outer and upper end portion 63 of a shaft 125 which is mounted in a bearing housing 148 in the power head housing 49 (FIG. 11).

In the use of the new casket-placer and casket-lowering apparatus 40 the hand crank member 62 may be attached to the upper end portion 123 of the shaft 125 and rotated for retrieval or rewinding of the flexible casket-supporting and casket-lowering strap members 57 after the conclusion of the graveside and interment services.

When the hand crank 62 is attached to the shaft 125 and rotated for retrieval or rewinding of the flexible casket-supporting and casket-lowering strap members 57 at the conclusion of the graveside and interment services, the rotation of the hand crank 62 and shaft 25 acts through the gears 84, 81, 80, 79, shaft 78, gear 86, gear 89, shaft 90, gear 92 to rotate the inner square in cross section tubular members 127 of the side rail members 42 and 43 and the rotatable parts of the end rail members 45, and outer rotatable side rail members 126 in a ratio of 7.5 for the retrieval of the flexible strap members 57 and rewinding them onto the outer tubular members 126 of the side rail members 42 and 43 in a step up ratio of 4 to 1 through the gear system described immediately above, thus retrieving and rewinding the flexible strap members 57 onto the outer tubular members 126 of the side rail members 42 and 43.

THE MEANS FOR RAISING THE CASKET 41 DURING THE GRAVESIDE OR INTERMENT SERVICES IF AND WHEN IT BECOMES NECESSARY TO DO SO (FIGS. 7 AND 12)

It may become necessary for the funeral director to raise the casket 41 on the flexible strap members 57 during the graveside or interment services, and the new casket-placer and casket-lowering apparatus 40 provides a means for this purpose. This means is shown in FIGS. 7 and 12 wherein it is generally indicated at 141 and includes the shaft 82 having an upper squared head portion 81 to which the hand crank member 62 may be detachably attached. When the hand crank member 62 is attached to the head 81 of the shaft 82 and the shaft 82 is rotated it acts, through the gears 81, 80, gear shaft 78, gears 141 and shaft 93, to rotate the inner and outer rotatable tubular members 126 and 127, respectively, of the side rail member 42 and thence to rotate the front end rail 45 through the inner side rail member 127 of the side rail 43 and the shaft 159, gears 161 and 162 and the parts 165 and 166 of the front end rail 45 (FIG. 32), and thence to the shaft and gear mechanism in the combination braking and power transmission head 48 (FIG. 32), the outer rotatable member 127 of the side rail members 43 and the inner rotatable member 127 thus raising the casket 41 on the flexible strap members 57 and rewinding the flexible strap members 57 on the spools or reels 58.

The gear mechanism described above for raising the casket 41 on the flexible strap members 57, is preferably in a step-up ratio of 2 to 1 to facilitate the operation of raising the casket 41 which is preferably in a step-up ratio of 18 to 1 compared to the normal speed of lowering the casket 41.

THE MEANS FOR VARYING THE WIDTH OF THE APPARATUS TO ACCOMMODATE IT TO GRAVE OPENINGS OF VARYING WIDTHS (FIGS. 30 AND 32)

The present invention provides means for adjusting the width of the apparatus to enable it to be accommodated to grave openings of varying widths. This means is shown in FIG. 32 and includes telescopic constructions of the two end rail members 44 and 45. Thus, as shown in FIGS. 30 and 32, the lower end rail member 44 includes a first telescopic rod member 167 which has its outer end portion rigidly attached, as at 169, to a side wall of the idler housing 50. This first telescopic rod member 167 includes into and is slidably adjusted in a second tubular member 168 which has its outer end portion rigidly attached, as at 170, to a side wall of the idler housing 46.

Similarly, the end rail unit 45 includes the shaft 165 which projects into and is slidably mounted in a tubular telescopic member 185 into which also projects a shaft 166–134 which at its outer end carries a gear 100 which meshes with the gear 90 in the combination braking and power transmission head 48 (FIG. 32).

As will readily be seen from FIGS. 30 and 32 the new apparatus 40 may be adjusted laterally to enable it to be accommodated to grave openings of varying widths by manually or otherwise pressing inwardly or outwardly on the side rails 42 and 43 as to telescope the shaft 167 in the telescopic tubular member 68 and so as to telescopically move the shaft 165 and 166 within the tubular member 185 (FIG. 32).

SUMMARY DESCRIPTION OF THE OPERATION OF THE CASKET-PLACER AND CASKET-LOWERING APPARATUS 40

In the use of the new casket-placer and casket-lowering apparatus 40 the apparatus is arranged over the grave opening with the combination braking and power transmission head unit 48 and the head units 46, 50 and 52 resting on the ground surface at the four corners of the grave opening and with the casket-placer and casket-lowering arm members 54 arranged in horizontal and latched position on the side rail members 42 and 43, as shown in FIGS. 1 to 6, inclusive. At this time the combination braking and power transmission head unit 48 and associated parts are latched against movement by the engagement of the latching head 11 of the latching plunger 108 with the teeth of the gear 84, as shown in FIGS. 7 and 9.

The casket 41 is then inserted by the pallbearers endwise onto the casket-placer and casket-lowering arm members 54, as shown in FIG. 2, into the position in which it is shown in FIG. 3, with the weight of the casket 41 bearing downwardly on the casket-placer and casket-lowering members 54.

The funeral director then unlatches the combination braking and power transmission head unit 48 and the gear train and other parts operatively connected thereto, by imparting a partial revolution of the latch knob handle 112, and attached shaft 124, and the latching plunger 108, so as to rotate the pin 112 in the bayonet slot 113 in the latching plunger 108 (FIG. 8), whereupon the coil spring 116 on the shaft 124 will urge the parts from latched position, as in FIGS. 7 and 9, into unlatched position, as in FIG. 10, and thus disengage the latching head 111 on the latching plunger 108 from engagement with the teeth of the gear 84 and thereby freeing the combination braking mechanism and power transmission head unit 48 and associated gear train and other parts operatively connected thereto for operation.

Figure 4:
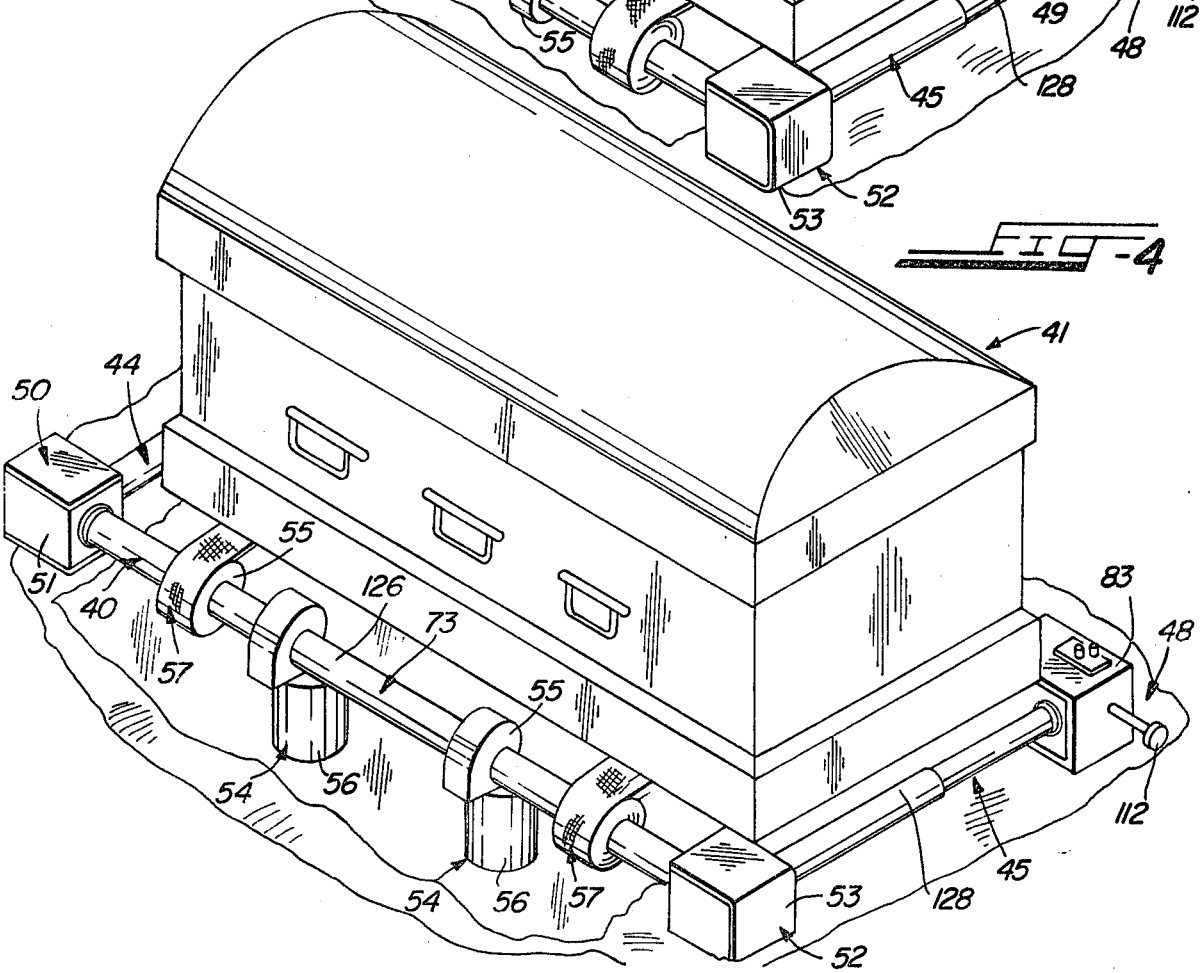
FIG. 4 is a perspective view, similar to FIG. 3, but showing the casket partially lowered, after the graveside service, onto the flexible casket-supporting and casket-lowering strap members after having been partially lowered on the casket-placer and casket-lowering arm members.

As the weight of the casket 41 bears down on the casket-placer and casket-lowering arm members 54 the arm members 54 initiate rotational movement of the inner and outer side rail members 126 and 127, respectively, thereby causing the casket-placer and casket-lowering arm members 54 to pivot or rotate downwardly, on the body portions 55 thereof which are attached to the inner rotatable side rail members 127, into the generally vertical and unlatched position, in which they are shown in FIGS. 4 and 24.

In the use and operation of the new casket-placer and casket-lowering apparatus 40, when the casket 41 is first placed on the casket-placer and casket-lowering arm members 54, and then later drops onto the flexible strap members 57, as the placer arms become unlatched from the inner side rail members 127, the weight of the casket 41 on the flexible strap members 57 causes the outer side rail members 126 to rotate and this action of the outer side rail members 126 is transmitted to the inner side rail members 127 and their inner shafts 159–179–183–184–146 through the connection shown in FIG. 25, through the gears 161 and 162 in the housing 52 (FIG. 32), telescopic shafts 165–185–166, gears 100 and 90, gear 86, shaft 86, gears 84, 81 and 80, to the shaft 78 of the D.C. motor generator 60, thereby rotating the armature of the D.C. motor generator 60 and creating a preset threshold electrical current voltage in the electronic braking and loading circuit 59 which acts to brake and control the lowering speed of the casket 41, first on the casket-placer and casket-lowering arm members 54, and later on the flexible strap members 57.

As pointed out above, the rotational movement of the armature of the D.C. electric motor generator 60 creates a voltage in the electronic braking and loading circuit 59 (FIG. 17) and as the speed of rotation of the side rail members increses, as the casket 41 is lowered into the grave opening, or into the base 143 of a burial vault, the speed of rotation of the armature of the D.C. electric motor generator 60 increases correspondingly. During this time the flow of electric current through the electronic braking circuit 59 increases and exerts a braking action to prevent the lowering speed of the rotatable inner side rail members 127 and their internal shafts 159–167 and 184–183 and of the rotatable parts of the telescopic front end rail member 45 (FIG. 52), from overaccelerating, thereby creating a braking action on the speed of the lowering action of the casket 41. Ths control is accomplished by the ZENER diode 77 due to the fact that the D.C. electric motor generator 60 works on a dynamic braking principle as a generator or alternator, that is, the greater the load the greater the turning force required to turn its armature or conversely. As the load, in the form of the weight of the casket 41, is held constant, the force or speed required to turn the armature of the D.C. motor generator 60 can thus be controlled. To this end the electronic braking circuit 59 incorporates the ZENER diode 77 which is a semi-conductor device which will allow no electrical flow in one direction in the circuit 59 until a pre-determined threshold voltage is reached, but at that point the ZENER diode 77 will conduct electricity. The selection of the threshold voltage determines the speed at which the armature of the motor generator 60 will rotate.

Since the output voltage of a generator is related to its armature speed, by controlling the output voltage of the motor generator 60 the new casket-placer and casket-lowering apparatus 40 is able to control the armature speed of the motor generator 60 and hence the lowering speed of the casket 41. Thus, the function of the ZENER diode 77 is to regulate the voltage provided by the motor generator 60 in the electronic braking and loading circuit 59. Below the predetermined threshold voltage level of the ZENER diode 77 the braking effect, or regulation provided by the motor generator 60 is zero, neglecting friction. As the inertia of the lowering casket 41 increases, it tends to turn the armature of the motor generator 60 at a speed greater than that which will produce the predetermined threshold voltage. However, above the threshold voltage, the terminals of the genertor "see" a short circuit and the current in the windings increase until the braking effect on the armature by the permanent magnets is sufficient to keep the armature at the speed which will produce the threshold votage.

The second diode 76 removes the braking effect from the gear train when the flexible strap members 57 are rewound onto the outer tubular members 126 of the side rails 42 and 43 after the graveside and interment services have been completed. This retrieval of the flexible strap members 57 is accomplished, as described hereinbefore, by the rotation of the hand crank member 62 on the shaft 125, gears 84, 79, 86, 89, shaft 90, gear 92 to rotate the inner and outer tubular members 126 and 127 of the side rail members 126, in a ratio of 7.5 for the retrieval of the flexible strap members 57 and rewinding them onto the outer tubular members 126 of the side rails 42 and 43 in a step up ratio of 4 to 1 through the gear system described hereinbefore, thus retrieving and rewinding the flexible strap members 59 onto the outer tubular members 126 of the side rails 42 and 43 and during this operation the motor generator 60 "sees" an open circuit and, neglecting friction, provides no damping action to impede retrieval of the flexible strap members 57.

As the flexible casket-supporting and casket-lowering strap members 57 are retrieved by rotation of the hand crank member 62, shaft 125 and associated parts, as described hereinbefore, the motor generator 60 will also be rotated and will create an increase force opposing the strap retrieval action, and in order to overcome this opposition force the second diode 76 is incorporated in the electrical control circuit 59, as shown in FIG. 17. This second diode 76 functions as a one way switch and disconnects the electric motor generator 60 as the hand crank 62, shaft 125 and related gear train are rotated during the retrieval of the flexible strap members 57.

After the close of the graveside and interment services at the grave opening the flexible strap members 57 may be manually detached from the outer tubular members 126 of the side rails 42 and 43, if desired, rather than being retrieved, as described hereinbefore.

In the event that the funeral director should wish to render the flexible straps 57 taut before the graveside and interment services commences, or should he wish to raise the casket 41 on the flexible strap members 57 for any reason during the graveside or interment serivces, this may be accomplished by attaching the hand crank member 62 to the squared end portion 81 of the shaft 82 and rotating the shaft 82. This rotation of the shaft 82 acts, through the gear train 81, 80, gear 78, gear 141 and shaft 93, to rotate the inner rotatable shaft members 127 of the side rail members 42 and 43 and their internal shaft 184—184, and the outer tubular members 126 of the side rails 42 and 43, parts 159–179, gears 161 and 91, and the rotatable parts of the telescopic end rail member 45, and the shaft and gear mechanism in the combination braking and power transmission head 48, and related parts, thus raising the casket 41 on the flexible strap members 57 and rewinding the flexible strap members 57 on the outer tubular members 126 of the side rails 42 and 43.

The gear ratio described above for raising the casket 41 on the flexible strap members 57, is preferably in a step up ratio of 20 to 1 to facilitate the operation of raising the casket 41 which is preferably in a step up ratio of 18 to 1 compared to the normal speed of lowering the casket 41.

After the conclusion of the graveside and interment services the casket-placer and casket-lowering arm members 54 may be removed from the side rails 42 and 43 and retained by the funeral director for use at another graveside and interment service employing the new casket-placer and casket-lowering apparatus 40. This removal of the casket-placer and casket-lowering arm members 54 from the side rail members 42 and 43, is accomplished as described hereinbefore, namely, by removing the latch pin 131 from the body of the placer arm 54 (FIG. 16).

As described hereinbefore, the new apparatus may be adjusted laterally by adjustment of the telescopic end rail members 44 and 45 to accommodate it to grave lengths of varying widths.

The tubular members and shafts of the side rail members 42 and 43 and their internal shafts and the parts of the telescopic end rail members 44 and 45 may be of suitable quality and thickness of corrosion-resistant steel, aluminum, or other suitable material, and the four generally square corner housings 48, 46, 50 and 52 may be made of a suitable quality of corrosion-resistant steel or aluminum or other suitable material, and fabricated to be water-resistant.

The new casket-placer and casket-lowering apparatus 40 has a number of advantages over the prior art of such apparatus which have commonly employed control means for regulating the rotational movement of the side rail members and the flexible casket-supporting and casket-lowering strap members, such prior art control means including flyweight governors which increase the pressure on friction elements in the braking device through the use of a lever mechanism to control the rotational movement of the side rail members and the lowering action of the casket, as 41. However, such prior art devices have several objectionable features including the fact that the degree of friction applied by the flyweight governor to the friction elements in the braking device has resulted in wear on the friction elements and this problem has been increased by action of grease, oil or other foreign matter accumulating on the friction elements, thereby diminishing the braking ability of the prior art devices and sometimes causing resulting structural failures.

However, in the use of the new casket-placer and casket-lowering apparatus 40 many of the problems and difficulties experienced in the use of comparable prior art devices are eliminated and the rotational movement of the side rail members 42 and 43 and related parts and of the flexible strap members 57 is carefully controlled since the braking action on these parts is under control of the electrical control circuit 59 and the motor governor 60 and is electromechanical and does not employ any friction elements for this purpose.

Moreover, in the use of the new casket-placer and casket-lowering apparatus 40 the electrical control circuit 59 automatically compensates for variations in temperature, load and internal friction in the device.

In the use of the new casket-placer and casket-lowering apparatus 40, the ZENER diode 77 functions as a semi-conductor device which allows no electrical current flow in one direction in the electrical control circuit 59 until a predetermined threshold voltage is reached but at that point the ZENER diode 77 will conduct electrical current in the electrical control circuit 59.

As is well known in the art, in those uses in which the casket 41 is lowered into the base 143 of a burial vault, after completion of the graveside service, the base 143 of the burial vault with the casket 41 therein are raised up from the grave opening and the cover of the vault sealed to the base 143, after which the thus sealed vault with the casket 41 therein are lowered, by suitable means (not shown) into the grave opening for final interment.

It will thus be seen from the foregoing description, considered in conjunction with the accompanying drawings, that the present invention provides a new and improved casket-placer and casket-lowering apparatus and accomplishes its intended objects and purposes and has the advantages including those pointed out hereinbefore and others which are inherent in the invention.

We Claim:

1. Apparatus for lowering a casket into a grave opening, or into the base of a burial vault in the grave opening, having four corner locations at the ground surface adjacent the said grave opening, comprising:

(a) a generally rectangular-shaped supporting frame adapted to be arranged over the said grave opening and including
  (1) a pair of generally parallel side rail members adapted to be arranged adjacent the sides of the said grave opening and including
    a. a first side rail member; and
    b. a second side rail member; and
  (2) a pair of generally parallel end rail members adapted to be arranged adjacent the ends of the said grave opening including
    a. a first end rail member; and
    b. a second end rail member;

(b) a combination braking and power transmission head arranged at one corner of the said apparatus and at one of the said corner locations at the said ground surface of the said grave opening;

(c) means operatively interconnecting one of the said end rail members with one of the said side rail members and with the said power transmission means for rotational movement together;

(d) means operatively interconnecting the second one of said side rail members with the said power transmission means for rotational movement together;

(e) casket-placer and casket-supporting means carried by the said side rail members and movably downwardly thereon into the grave opening under the rotational movement of the said side rail members for supporting a casket in position on the said apparatus above the grave opening for a graveside service and for lowering the casket into the grave opening after conclusion of the graveside service; and (f) means including
  (1) electronically controlled braking means in the said braking and power transmission head under the control of the said casket-placer and casket-supporting means and operable by the weight of a casket resting on the said casket-placer and casket-supporting means and the rotational movement of the said side rail members and one of the said end rail members for controlling the speed of rotation of the said casket-placer and casket-supporting means and the speed of the lowering movement of the casket into the grave opening.

2. Apparatus as defined in claim 1 in which the said electronically controlled braking means includes (a) electrical circuit means including
  (1) an electric motor-generator including an armature rotatably mounted in the said combination braking and power transmission head;
  (2) power transmission means under the control of the said side rail member and one end rail member for rotating the armature of the said electric motor generator to generate an electrical current in the said electrical circuit means; and
  (3) means in the said combination braking and power transmission head for controlling and braking the rotational movement and speed of rotation of the said electrical motor generator and the rotational movement of the said side rail members and the downward movement of the said casket-placer and casket-lowering means and the speed of the lowering action of the casket into the said grave opening.

3. Apparatus as defined in claim 2 in which the (a) said means for controlling and braking the rotational movement and speed of the said electric motor generator includes
  (1) ZENER diode means for controlling the flow of electric current generated by the said electric motor generator in and through the said electrical circuit means.

4. Apparatus as defined in claim 2 in which (a) the said combination braking and power transmission head unit includes
  (1) a power transmission housing; and in which the said power transmission means includes
  (2) shaft and gear means arranged in the said combination braking and power transmission head housing; and in which the said apparatus includes (b) manually controlled latching means movably mounted in the said combination braking and power transmission head housing for releasably latching the said power transmission means against rotation prior to the commencement of the graveside service.

5. Apparatus as defined in claim 4 in which (a) the said manually controlled latching means includes (b) a manually controlled latch member movably mounted on the said combination braking and power transmission head housing and having a handle member thereon projecting exteriorly of the said combination braking and power transmission head housing for operating the said manually controlled latching means.

6. Apparatus as defined in claim 4 in which the said manually controlled latching means includes (a) a latch member movably mounted in the said combination braking and power transmission head housing and including
  (1) a latching element adapted to be latchingly engaged with the said power transmission means;

(b) a handle member projecting exteriorly of the said combination braking and power transmission housing for operating the said manually controlled latching means; and (c) means in the said combination braking and power transmission head housing for urging the said latch member and said latching element thereon into latching engagement with the said power transmission means.

7. Apparatus as defined in claim 1 in which (a) the said casket-placer and casket-supporting means includes
(1) casket-placer and casket-supporting arm members arranged in horizontally spaced relationship on the said side rail members;
(b) means for releasably latching the said casket-placer and casket-supporting arm members on the said side rail members and in position projecting generally horizontally inwardly from the said side rail members over the grave opening for the reception and support of a casket at the commencement of the graveside service; and
(c) means for releasably unlatching the said casket-placer and casket-supporting arm members from the said side rail members as the said side rail members are rotated to lower the casket into the grave opening and as the said casket-placer and casket-supporting arm members are moved by the said side rail members into a generally vertical position in the grave opening.

8. Apparatus as defined in claim 7 which includes
(a) means for detachably mounting the said casket-placer and casket-supporting arm members on the said side rail members to enable the said casket-placer and casket-supporting arm members to be removed from the said side rail members at the conclusion of the graveside service and the interment of the casket.

9. Apparatus as defined in claim 1 in which the said casket-placer and casket-supporting means includes
(a) flexible casket-supporting strap members extending between and windable on and off from the said side rail members and adapted to project across the grave opening to support a casket above and in the grave opening.

10. Apparatus as defined in claim 7 in which the said casket-placer and casket-supporting means includes
(a) flexible casket-supporting strap members extending between the said side rail members and adapted to project across the grave opening below the said casket-placer and casket-supporting arm members when the said casket-placer and casket-supporting arm members are in a generally horizontal position;
(b) fastening means mounted on the said side rail members for rotational movement therewith and having the said flexible casket-supporting strap members detachably attached thereto and adapted to have the said flexible casket-supporting strap members unwound therefrom on rotational movement of the said side rail members under the weight of the casket resting on the said flexible strap members as the casket is lowered into the grave opening and the weight of the casket is shifted from the said casket-placer and casket-supporting arm members onto the said flexible strap members as the casket-placer and casket-supporting arm members are moved downwardly on the said side rail members into a generally vertical position in the grave opening.

11. Apparatus as defined in claim 1 in which the said combination braking and power transmission head includes
(a) a housing;
(b) flexible casket-supporting strap members extending between the said side rail members and adapted to project across the grave opening to support a casket at the grave opening.
(c) fastening means mounted on the said side rail members for rotational movement therewith and having the said flexible casket-supporting strap members detachably attached thereto and adapted to have the said flexible casket-supporting members unwound therefrom on rotational movement of the said side rail members under the weight of the casket resting thereon as the casket is lowered into the grave opening;
(d) and in which the said electrical circuit means includes
(1) an electrical D. C. motor-generator rotatable mounted in the said combination braking and power transmission housing; and in which the said apparatus includes
(e) first gear and shaft means in the said combination braking and power transmission head housing for rotating the said side rail members and the said electric motor-generator to rewind the said flexible casket-supporting strap members onto the said side rail members after the conclusion of the graveside service and interment; and in which
(f) the said apparatus includes
(1) a first shaft member operatively connected to the said gear means in the said combination braking and power transmission head housing and having
(2) an outer end and handle crank member receiving portion projecting externally of the said combination braking and power transmission head housing; and
(g) a hand crank member detachably mounted on the said hand crank receiving portion of the said shaft member for manually rotating the said gear and shaft means and the said electric motor-generator and the said side rail members in a direction to rewind the said flexible casket-supporting strap members onto the said side rail members at a relatively low and preselected speed after the conclusion of the graveside service and interment.

12. Apparatus as defined in claim 10 which includes
(a) second shaft means and gear means in the said combination braking and power transmission head housing;
(1) the said second shaft means having a crank-receiving portion projecting externally of the said combination braking and power transmission head housing and adapted to have the said hand crank member detachably mounted thereon for rotating the said second shaft means and gear means and the said electric motor generator and the said side rail members in a direction to rewind the said flexible casket-supporting strap members onto the said side rail members and to raise the casket during the interment service at a relatively faster speed than is accomplished by the said first shaft and gear means during the graveside service or interment service.

13. Apparatus for supporting a casket above a grave opening during a graveside service and for lowering the casket into a grave opening, or into the base of a burial vault in the grave opening, at the conclusion of the graveside service, comprising:
(a) a generally rectangular-shaped frame adapted to be arranged above a grave opening and including
(b) parallel side rail members; and
(c) parallel end rail members;

(d) each of the said side rail members including
(1) an outer rotatable tubular member; and
(2) an inner rotatable tubular member;

(e) casket-placer and casket-supporting arm members mounted in spaced relationship on the said outer rotatable members of the said side rail members for rotational movement therewith and for placing a casket in position above the grave opening during a graveside service and for lowering the casket into the grave opening at the conclusion of the graveside service;

(f) means for detachably latching each of the said arm members to the inner rotatable members of the said side rail members to retain the said arm members in a generally horizontal position projecting over the grave opening to support a casket during the graveside service;

(g) means for automatically unlatching each of the said arm members from the said inner rotatable members of the said side rail members as the said outer rotatable members of the said side rail members and the said arm members are rotated into a generally vertical position to lower the casket into the grave opening at the conclusion of the graveside service;

(h) means cooperating with the said casket-placer and casket-supporting arm members and the said outer rotatable members of the said side rail members for rotating the said outer rotatable members of the said side rail members and the said casket placer and casket-supporting arms mounted thereon under the weight of a casket resting on and bearing downwardly on the said casket-placer and casket-supporting arm members; and (i) electrically controlled braking means powered by downward movement of the casket for braking and controlling the rotational movement of the said side rail members and the said casket-placer and casket-supporting arm members mounted thereon in lowering the casket into the grave opening under the weight of the casket resting on the said casket-placer and casket-supporting arm members after conclusion of the graveside service.

14. Apparatus as defined in claim 12 which includes (a) flexible casket-supporting strap members extending between the said side rail members and adapted to project across the grave opening below the said casket-placer and casket-supporting arm members when the said casket-placer and casket-supporting arm members are in a generally horizontal position;

(b) fastening means mounted on the said side rail members for rotational movement therewith and having the said flexible casket-supporting strap members detachably attached thereto and adapted to have the said flexible casket-supporting strap members unwound therefrom on rotational movement of the said side rail members under the weight of a casket resting on the said flexible strap members as the casket is lowered into the grave opening and the said casket-placer and casket-supporting arm members are rotated on the said side rail members and the weight of the casket is shifted from the said casket-placer and casket-supporting arm members onto the said flexible strap members as the casket-placer and casket-supporting arm members are moved downwardly on the said side rail members into a generally vertical position in the grave opening.

15. Apparatus as defined in claim 13 in which the said means for detachably latching each of the said arm members to one of the said side rail members includes (a) a gear rigidly attached to the said inner rotatable member of each of the said side rail members and having on its peripheral surface
(1) gear teeth; and
(2) valleys between the said gear teeth; and in which each of the said arm members includes (b) a body surrounding the said gear including
(1) a body portion including a generally annular peripheral surface surrounding the said gear teeth and valleys and having
(2) roller-receiving sockets formed thereon; and said apparatus including
(3) a roller member movably mounted on the said body of the said arm member and having a plurality of rollers mounted thereon and adapted to be disposed in the said roller-receiving sockets and said valleys and engaging the said teeth of the said gear when the said arm member is disposed in a generally horizontal position projecting over the grave opening to support a casket thereon; and in which the said body of the said arm member has formed therein (c) a second group of the said roller-receiving sockets formed in the said body and located radially outwardly of the said first group of roller-receiving sockets;

(d) means for unlatching the said arm members from the said inner tubular members of the said side rail members when the said side rail members and the said arm members are rotated to dispose the said arm members in a generally vertical position in the grave opening; and in which the said unlatching means includes (e) the said roller member being movable by gravity to move the said rollers radially outwardly of the said first group of roller-receiving sockets into the said second set of roller-receiving sockets and out of engagement with the said gear teeth as the said arm member is rotated from its generally horizontal position in the grave opening;

16. Apparatus for placing a casket over a grave opening for viewing during a graveside service and for lowering it into the grave opening, or into the base of a burial vault in the grave opening, for interment at the conclusion of the graveside service comprising:

(a) a generally rectangular-shaped frame adapted to be arranged over a grave opening and supported on the adjacent ground surface and including
(1) generally parallel side rail members; and
(2) generally parallel end rail members;

(b) each of the said side rail members including
(1) an outer rotatable tubular member; and
(2) an inner rotatable tubular member;

(c) means operatively interconnecting the said inner rotatable members of the said side rail members and one of the said end rail members for rotational movement together;

(d) casket-supporting means mounted on the said side rail members and rotatable with the said inner and outer rotatable members thereon and projecting inwardly from the said side rail members and adapted to support a casket over a grave opening during a graveside service and for lowering the casket into the grave opening for interment after the conclusion of the graveside service;

(e) power transmission means responsive to the weight of the casket on the said casket-supporting means for rotating the said side rail members and the said one end rail member together; and (f) electronically controlled braking means powered by downward movement of the casket for braking and controlling the rotational movement of the said side rail members and downward movement of the said casket supporting means and the lowering movement of the casket into the grave opening after the conclusion of the graveside service.

17. Apparatus as defined in claim 16 which includes (a) manually operable latching means for latching the said power transmission means against movement and for unlatching the said power transmission means and the said side rail members and the said one end rail member and the said casket-supporting means for rotational movement after the conclusion of the graveside service.

18. Apparatus as defined in claim 16 in which the said casket-supporting means is in the form of (a) casket-placer and casket-supporting arm members mounted in spaced relationship on the said side rail members and projecting generally horizontally inwardly from the said side rail members over the grave opening to place and support the casket during the graveside service;

(b) means responsive to the rotational movement of the said casket-placer and casket-supporting arm members on the said side rail members for unlatching the said casket-placer and casket-supporting arm members from the said inner tubular members of the said side rail members as the said casket-placer and casket-supporting arm members are rotated on the said side rail members into a generally vertical position as the casket is lowered into the grave opening for interment.

19. Apparatus as defined in claim 18 which includes (a) means for removably mounting the said casket-placer and casket-supporting arm members on the said side rail members and for removal from the said side rail members after the casket has been interred in the grave opening.

20. Apparatus as defined in claim 16 in which the said casket-supporting means is in the form of (a) flexible casket-supporting strap members extending between the said side rail members to support a casket over the grave opening and for lowering the casket into the grave opening for interment after the conclusion of the graveside service; and which includes (b) means for winding the said flexible strap members onto and unwinding them from the said side rail members after the concludion of the graveside service and as the casket is lowered into the grave opening for interment.

21. Apparatus as defined in claim 16 in which the said casket-supporting means includes (a) casket-placer and casket-supporting arms mounted in spaced relationship on the said side rail members and projecting horizontally inwardly therefrom over the grave opening to place and support the casket at the commencement of and during the graveside service;

(b) means for releasably latching the said casket-placer and casket-supporting arm members to the said side rail members for rotational movement during the graveside service;

(c) means responsive to the rotational movement of the said casket-placer and casket-supporting arm members on the said inner tubular members of the said side rail members for unlatching the said casket-placer and casket-supporting arm member from the said side rail members as the said casket-placer and casket-supporting arm members are rotated on the said side rail members into a generally vertical position as the casket is lowered into the grave opening for interment; and in which the said casket-supporting means includes (d) flexible casket-supporting strap members extending between the said side rail members and adapted to receive the casket from the said casket-placer and casket-supporting arm members as the casket-placer and casket-supporting arm members are rotated on the said side rail members from their initial and generally horizontal position in a generally vertical position in the grave opening; and (e) fastening means on the said side rail members for attaching the said flexible strap members onto and for unwinding them from the said side rail members after the conclusion of the graveside service and as the casket is lowered on the said flexible strap members in the grave opening for interment.

22. Apparatus for placing a casket over a grave opening for viewing during a graveside service and for lowering it into the grave opening, or into the base of a burial vault in the grave opening, for interment after the close of the graveside service, comprising:

(a) a casket-supporting frame adapted to be arranged above the grave opening and including (1) generally parallel side rail members adapted to be disposed adjacent the sides of the grave opening; and (2) generally parallel end rail members adapted to be disposed adjacent the ends of the grave opening;

(b) each of the said side rail members including (1) an outer rotatable tubular member; and (2) an inner rotatable tubular member;

(c) one of the said end rail members including (1) rotatable members;

(d) means rotatably interconnecting the said inner rotatable members of the said side rail members and the rotatable members of the said one end rail member for rotational movement together;

(e) casket-placer and casket-supporting means mounted on the said side rail members and adapted to extend across the grave opening to support a casket thereon during the graveside service and to lower the casket into the grave opening for interment after the conclusion of the graveside service;

(f) power transmission means responsive to the weight of a casket on the said casket-placer and casket-supporting means for rotating the said side rail members and the rotatable members of the said one end rail member in a direction to lower the casket on the said casket-placer and casket-supporting means into the grave opening for interment after the conclusion of the graveside service;

(g) latching means for latching the said power transmission means and the said side and the said one end rail member against rotational movement when the casket is positioned on the casket-placer and casket-supporting means during the graveside service;

(h) manually operable means for unlatching the said power transmission means for rotational movement of the said side rail members and the rotatable members of the said one end rail member for downward movement of the said casket-placer and casket-supporting means under the weight of the casket resting on the said casket-placer and casket-supporting means after the conclusion of the graveside service; and a (i) combination braking and power transmission head unit including (1) electromechanical speed governor and braking means powered by downward movement of the casket for controlling the speed of rotational movement of the said power transmission means and of the said side rail members and the rotatable members of the said one end rail member and the downward movement of the said casket-placer and casket-supporting means.

23. Apparatus as defined in claim 22 in which the said casket-placer and casket-supporting means includes (a) flexible casket-supporting strap members having (1) portions wound upon and (2) extending between the said side rail members and adapted to extend across the grave opening to support the casket thereon over the grave opening;

(b) fastening means mounted on the said side rail members for detachably attaching the said flexible strap members onto and for unwinding them off from the said side rail members; and (c) manually operable rewinding means for rotating the said power transmission means and the said side rail members in a direction to wind the said flexible strap members onto the said side rails after the casket has been interred in the grave opening.

24. Apparatus as defined in claim 23 in which the said manually operable rewinding means includes (a) means for rotating the said power transmission means and the said side rail members in a direction to wind the said flexible strap members onto the said side rails after the casket has been interred in the grave opening.

25. Apparatus as defined in claim 24 which includes (a) first speed control gear means for controlling the rotational speed of the said side rail members at a preselected speed when the said rewinding means and the said power transmission means are manually operated to rewind the said flexible strap members onto the said side rail members after the casket has been interred in the grave opening; and (b) second speed control gear means for controlling the rotational speed of the said power transmission means and of the said rail members in a direction to rewind the said flexible strap members onto the said side rails and to raise the said casket on the said flexible strap members during the interment operation.

26. Apparatus as defined in claim 23 in which the said electromechanical speed governor and braking means includes (a) an electrical control circuit having therein (1) a D.C. motor-generator including (a) a rotatable armature which is rotatable in response to a predetermined threshold voltage;

(2) current flow control and loading means for preventing the flow of electrical current in the said control and loading circuit and rotation of the said armature of the said motor-generator until the said predetermined threshold voltage has been reached; and (3) means operatively interconnecting the said power transmission means and the said armature of the said motor-generator for rotational movement together.

27. Apparatus as defined in claim 26 in which (a) the said current flow control and loading means is in the form of (1) a ZENAR diode semi-conductor device.

28. Apparatus as defined in claim 26 in which the said electrical current flow control and loading circuit includes (a) switch means for electrically disconnecting the said motor-generator from the said electrical current flow control and loading circuit when the said power transmission means is rotated in a direction to rewind the said flexible strap members onto the said side rails after the casket has been interred in the grave opening.

29. Apparatus as defined in claim 28 in which the said switch means is in the form of (a) a second diode.

30. Apparatus for placing a casket over a grave opening for a graveside and interment service and for lowering the casket into a grave opening or into the base of a burial vault in the grave opening after completion of the graveside service comprising:

(a) a supporting frame adapted to be placed over a grave opening and supported on the ground surface adjacent the grave opening;

(b) casket-placer means carried by the said supporting frame for placing and supporting a casket above the grave opening during the graveside service;

(c) casket-supporting and lowering means movably mounted in the said supporting frame and responsive to the weight of the casket bearing thereon for supporting and lowering the casket into the grave opening or into the base of a burial vault in the grave opening after completion of the graveside service; and (d) electromechanical braking and control means powered by downward movement of the casket and operatively connected to the said casket-supporting and lowering means for controlling and braking the rotational speed and the lowering action of the casket on the said supporting and lowering means.

31. Apparatus as defined in claim 30 in which the said electromechanical control means includes (a) an electronic braking and lowering circuit including (1) a D.C. motor generator including a. a rotatable armature;

(b) power transmission means operatively interconnecting the said casket-supporting and lowering means and the said aramture of the said D.C. motor generator, and responsive to the weight of a casket resting on the said casket-supporting and lowering means, for rotating the said armature to create an electrical current in the said electronic braking and lowering circuit;

(c) electronic current flow control means in the electronic braking and lowering circuit for preventing current flow in the said circuit until a predetermined threshold voltage has been generated in the said circuit by the said D.C. motor generator to control and brake the speed of the lowering action of the said casket-supporting and lowering means and of the casket supported thereon.

32. Apparatus as defined in claim 31 in which the said electronic braking and loading circuit includes (a) means for removing the braking effect of the said electronic current flow control means in the said electronic braking and loading circuit after the casket has been lowered into a grave opening or into the base of a burial vault in the grave opening.

33. Apparatus as defined in claim 1 which includes (a) means for laterally adjusting the said side rail members and the said end rail members to vary the width of the said apparatus to accommodate it to grave openings of varying widths.

34. Apparatus as defined in claim 33 in which (a) the said means for laterally adjusting the said side rail members and the said end rail members includes telescopically inteconnected members in the said end rail members.

35. Apparatus for placing a casket over a grave opening during a graveside service and for lowering the casket into the grave opening after the conclusion of the graveside service, comprising:

(a) a supporting frame adapted to be placed over the grave opening and including (b) casket-supporting and casket-lowering means cooperating with the said rotatable frame members of the said supporting frame for supporting the casket above the grave opening during the graveside service and for lowering the casket into the grave opening at the conclusion of the graveside service;

(c) the said supporting frame including (1) rotatable frame members responsive to and rotatable under the force of the weight of the casket on the said casket-supporting and casket-lowering means;

(d) means, powered by downward movement of the casket, for braking and controlling the speed of rotation of the said casket-supporting and casket-lowering means and the speed at which the casket is lowered into the grave opening, comprising (1) an electronic braking and control circuit including a. motor-generator including a rotatable armature;

b. means for rotating the said armature of the said motor-generator to generate an electrical current in the said electronic braking and control circuit; and (e) shaft and gear means operatively interconnecting the said rotatable frame members of the said supporting frame and the said means for rotating the said armature of the said motor-generator for simultaneous rotational movement together;

(f) means in the said electronic braking and control circuit for controlling the current flow through the said electronic braking and control circuit and for exerting a braking action on the rotational speed of the said armature of the said motor-generator and on the said rotatable frame members and on the said shaft and gear means to control the lowering action of the said rotatable frame members of the said supporting frame and to prevent them from overaccelerating beyond a preset speed.

36. A casket-placer and casket-supporting arm member adapted to be detachably mounted on an inner rotatable tubular member of the side rail of a generally rectangular-shaped frame of a casket-placer and casket-lowering apparatus, wherein the side rail comprises a gear mounted to the inner rotatable member, which gear defines a plurality of gear teeth separated by valleys disposed therebetween, and wherein said apparatus is adapted to be arranged over a grave opening to support the casket during a graveside service and for lowering the casket into a grave opening, or into the base of a burial vault in the grave opening, after completion of the graveside service, said casket-placer and casket-supporting arm member comprising (a) means for detachably latching the said casket-supporting arm member to the said inner rotatable member of the said side rail member and in a position to project inwardly from the side rail member into a generally horizontal position over the grave opening to place and support a casket over the grave opening at the commencement of and during a graveside service;

and (b) means for automatically unlatching the said body thereof by gravity from latching engagement with the said inner tubular member of the said side rail member as the said side rail member and the said casket-supporting arm member are rotated in a direction to position the said casket-supporting arm member in a generally vertical position and projecting downwardly into the grave opening, said automatically unlatching means comprising:

(1) a body portion including a generally annular peripheral surface surrounding the said gear teeth and valleys and having (2) roller-receiving sockets formed thereon;

(3) a roller member movably mounted on the said body of the said arm member and having a plurality of rollers mounted thereon and adapted to be disposed in the said roller-receiving sockets and said valleys and engaging the said teeth of the said gear when the said arm member is disposed in a generally horizontal position projecting over the grave opening to support a casket thereon; and (4) a second group of the said roller-receiving sockets formed in the said body and located radially outwardly of the said first group of roller-receiving sockets;

(5) the said roller member being movable by gravity to move the said rollers radially outwardly of the said first group of roller-receiving sockets into the said second set of roller-receiving sockets and out of engagement with the said gear teeth as the said arm member is rotated from its generally horizontal position in the grave opening.

37. A casket-placer and casket-supporting arm member as defined in claim 36 which includes (a) means for detachably mounting the said casket-supporting arm member on the said inner tubular member of the said side rail member and for removal therefrom when the said casket-placer and casket-supporting member is moved into a generally vertical position projecting downwardly into the grave opening and is automatically unlatched from the said side rail member.

* * * * *

UNITED STATES PATENT AND TRADEMARK OFFICE

CERTIFICATE OF CORRECTION

PATENT NO. : 4,413,390

DATED : November 8, 1983

INVENTOR(S) : Herbert R. Blaese and Christopher R. Lorenc

It is certified that error appears in the above-identified patent and that said Letters Patent is hereby corrected as shown below:

Column 27, Line 37, Claim 24, please delete "claim 23", and substitute therefor --claim 22--.

Column 28, Line 55, Claim 31, please delete "(1) a D.C. motor generator including a. a rotatable armature;", and substitute therefor --(1) a D.C. motor generator including
a. a rotatable armature;--.

Column 29, Line 19, Claim 34, please delete "inteconnected", and substitute therefor --interconnected--.

Signed and Sealed this

*Twentieth* Day of *August 1985*

[SEAL]

*Attest:*

DONALD J. QUIGG

*Attesting Officer* *Acting Commissioner of Patents and Trademarks*